US010723129B2

(12) United States Patent
Tsukahara et al.

(10) Patent No.: US 10,723,129 B2
(45) Date of Patent: Jul. 28, 2020

(54) LIQUID EJECTING HEAD AND LIQUID EJECTING APPARATUS

(71) Applicant: SEIKO EPSON CORPORATION, Tokyo (JP)

(72) Inventors: Katsutomo Tsukahara, Shiojiri (JP); Motoki Takabe, Shiojiri (JP); Yuma Fukuzawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/253,806

(22) Filed: Jan. 22, 2019

(65) Prior Publication Data

US 2019/0224971 A1 Jul. 25, 2019

(30) Foreign Application Priority Data

Jan. 23, 2018 (JP) ..... 2018-008982

(51) Int. Cl.
*B41J 2/14* (2006.01)

(52) U.S. Cl.
CPC ..... *B41J 2/14201* (2013.01); *B41J 2/14233* (2013.01); *B41J 2002/14411* (2013.01); *B41J 2002/14419* (2013.01); *B41J 2002/14491* (2013.01); *B41J 2202/11* (2013.01); *B41J 2202/12* (2013.01); *B41J 2202/18* (2013.01)

(58) Field of Classification Search
CPC ..... B41J 2/14201; B41J 2/14233; B41J 2202/11; B41J 2002/14419; B41J 2202/18; B41J 2002/14411; B41J 2202/12; B41J 2002/14491
See application file for complete search history.

(56) References Cited

U.S. PATENT DOCUMENTS

2011/0181643 A1* 7/2011 Yamashita ..... B41J 2/14233 347/10
2012/0176450 A1 7/2012 Akahane et al.
2012/0182354 A1* 7/2012 Akahane ..... B41J 2/14233 347/54

FOREIGN PATENT DOCUMENTS

JP 5750753 B 7/2015
JP 2016-107495 A 6/2016
JP 2018-103602 A 7/2018

OTHER PUBLICATIONS

IP.com search (Year: 2019).*

* cited by examiner

*Primary Examiner* — Erica S Lin
(74) *Attorney, Agent, or Firm* — Workman Nydegger

(57) ABSTRACT

Disclosed is a liquid ejecting head including a flow passage forming section in which a pressure chamber which communicates with a nozzle ejecting liquid and a circulation liquid chamber which communicates with the pressure chamber to circulate the liquid are formed, a driving element that generates pressure change in the pressure chamber, a circuit board for driving the driving element, and a connecting terminal that electrically connects the driving element with the circuit board, in which the connecting terminal overlaps the circulation liquid chamber in a plan view.

19 Claims, 13 Drawing Sheets

LIQUID EJECTING HEAD AND LIQUID EJECTING APPARATUS

BACKGROUND

1. Technical Field

The present invention relates to a technique for ejecting liquid such as ink.

2. Related Art

A liquid ejecting head that ejects liquid such as ink in a pressure chamber from nozzles by causing a pressure change in the pressure chamber by a driving element such as a piezoelectric element has been known. In such a liquid ejecting head, there are cases where a circuit board or the like including a drive circuit, a wiring, or the like for outputting a drive signal to a driving element is laminated on a pressure chamber substrate on which the pressure chamber is formed. For example, in JP-A-2016-107495, an energy generation means formation layer on which a plurality of piezoelectric elements are disposed and a circuit board (wiring pattern formation layer) are bonded with an adhesive, and a drive circuit and the piezoelectric elements are connected by a connecting terminal formed on the energy generation means formation layer on a pressure chamber substrate (pressure chamber formation layer).

The wiring and the connecting terminal generate heat when a current flows in the wiring and the connecting terminal by driving of the piezoelectric elements. Since the drive circuit also generates heat by the driving of the piezoelectric elements, the heat is transmitted via the wiring and the connecting terminal. Therefore, in a configuration in which the energy generation means formation layer on which the connecting terminal is formed is laminated between the pressure chamber substrate and the circuit board as disclosed in JP-A-2016-107495, heat tends to accumulate in a space of the energy generation means formation layer surrounded by the pressure chamber substrate and the circuit board. However, since there is no description about countermeasures against the heat from the connecting terminal and the piezoelectric elements are disposed in the space of the energy generation means formation layer in JP-A-2016-107495, there is a possibility that the characteristics of the piezoelectric elements change due to the influence of the accumulated heat in the space and thereby the ejection characteristic changes.

SUMMARY

An advantage of some aspects of the invention is to suppress change in ejection characteristic caused by heat.

According to an aspect of the invention, there is provided a liquid ejecting head including: a flow passage forming section in which a pressure chamber which communicates with a nozzle ejecting liquid and a circulation liquid chamber which communicates with the pressure chamber to circulate the liquid are formed; a driving element that generates pressure change in the pressure chamber; a circuit board for driving the driving element; and a connecting terminal that electrically connects the driving element with the circuit board, in which the connecting terminal overlaps the circulation liquid chamber in a plan view. In this case, since the connecting terminal overlaps the circulation liquid chamber in a plan view, the connecting terminal is very close to the circulation liquid chamber. Therefore, it is possible to effectively release the heat from the connecting terminal to the circulation liquid chamber compared to a case where the connecting terminal is far away from the circulation liquid chamber in a plan view so that the connecting terminal does not overlap the circulation liquid chamber. Accordingly, it is possible to suppress the temperature increase of the circuit board, and to protect the driving element from the heat, so that the change in the ejection characteristic due to the heat can be suppressed.

In the liquid ejecting head, the flow passage forming section may include a first flow passage substrate in which the circulation liquid chamber is formed and a second flow passage substrate which is bonded to the first flow passage substrate and in which the pressure chamber is formed, and the connecting terminal may be disposed on a side of the second flow passage substrate opposite to the first flow passage substrate. In this case, since the first flow passage substrate in which the circulation liquid chamber is formed is bonded to the second flow passage substrate, and the connecting terminal is disposed on the side of the second flow passage substrate opposite to the first flow passage substrate, the heat from the connecting terminal can be easily released to the circulation liquid chamber of the first flow passage substrate via the second flow passage substrate.

In the liquid ejecting head, the circulation liquid chamber may be configured of a first space formed in the first flow passage substrate and a second space formed in the second flow passage substrate, and the connecting terminal may be disposed on a side of the second flow passage substrate opposite to the second space. In this case, since the circulation liquid chamber is configured of the first space of the first flow passage substrate and the second space of the second flow passage substrate, and the connecting terminal is disposed on the side of the second flow passage substrate opposite to the second space, it is possible to bring the connecting terminal close to the circulation liquid chamber compared to the case where the circulation liquid chamber is formed only in the first flow passage substrate. Therefore, the heat from the connecting terminal can be easily released to the circulation liquid chamber.

In the liquid ejecting head, the circulation liquid chamber may extend in a direction in which a plurality of the pressure chambers are arranged, and the circulation liquid chamber may include a portion where a width of a cross section intersecting with a direction in which the circulation liquid chamber extends decreases as getting closer to a surface of the flow passage forming section on the connecting terminal side. In this case, since the circulation liquid chamber extends in a direction in which a plurality of the pressure chambers are arranged, and the circulation liquid chamber includes the portion where the width of the cross section intersecting the direction in which the circulation liquid chamber extends is narrowed as getting closer to the surface of the flow passage forming section on the connecting terminal side, it is possible to easily release the heat of the connecting terminal to the circulation liquid chamber while suppressing the decrease in the strength of the flow passage forming section.

In the liquid ejecting head, the circulation liquid chamber may include an inclined surface in which the width of the cross section decreases as getting closer to the surface of the flow passage forming section on the connecting terminal side. In this case, since the circulation liquid chamber includes the inclined surface in which the width of the cross section is narrowed as getting closer to the surface of the flow passage forming section on the connecting terminal side, it is possible to bring the circulation liquid chamber close to the connecting terminal side while suppressing the decrease of the strength of the flow passage forming section. Therefore, the heat of the connecting terminal can be easily released to the circulation liquid chamber while suppressing the occurrence of the cracks in the flow passage forming section.

In the liquid ejecting head, the circulation liquid chamber may include a curved surface in which the width of the cross section decreases as getting closer to the surface of the flow passage forming section on the connecting terminal side. In this case, since the circulation liquid chamber includes the curved surface in which the width of the cross section is narrowed as getting closer to the surface of the flow passage forming section on the connecting terminal side, it is possible to bring the circulation liquid chamber close to the connecting terminal side while suppressing the stress concentration of the flow passage forming section. Therefore, the heat of the connecting terminal can be easily released to the circulation liquid chamber while suppressing the occurrence of the cracks in the flow passage forming section.

In the liquid ejecting head, a plurality of the connecting terminals may be provided, and each of the connecting terminals may be included in a formation region of the circulation liquid chamber in a plan view. In this case, since the plurality of connecting terminals are included in the formation region of the circulation liquid chamber in a plan view, the heat from each of the connecting terminals is released to the circulation liquid chamber, so that the heat dissipation efficiency can be improved.

In the liquid ejecting head, the circuit board may be laminated on the flow passage forming section to seal an installation space of the driving element. In this case, since the circuit board is laminated on the flow passage forming section to seal the installation space of the driving element, it is possible to release the heat of the connecting terminal to the circulation liquid chamber while protecting the driving element with the circuit board. Moreover, since the circuit board is laminated on the flow passage forming section, it is easier to bring the connecting terminal for connecting the circuit board close to the flow passage forming section, so that the heat from the circuit board can be easily released from the connecting terminal to the circulation liquid chamber.

In the liquid ejecting head, the circuit board may include a protective member that is laminated on the flow passage forming section to seal the installation space of the driving element and a driving IC that is mounted on a side of the protective member opposite to the driving element, and the connecting terminal may connect the driving element to a wiring formed in the protective member and connected to the driving IC. In this case, the heat can be released from the connecting terminal to the circulation liquid chamber via the wiring of the protective member while protecting the driving element with the protective member. Accordingly, in the configuration in which the installation space of the driving element is sealed with the protective member, the heat tends to be accumulated in the sealed installation space of the driving element. From this point, since the heat can be efficiently released from the connecting terminal to the circulation liquid chamber, the heat cannot be accumulated in the installation space of driving element even if the installation space of the driving element is sealed with the protective member.

In the liquid ejecting head, the circulation liquid chamber may not overlap the pressure chamber in a plan view. In this case, since the circulation liquid chamber does not overlap the pressure chamber in a plan view, it is easier to bring the connecting terminal close to the circulation liquid chamber because the pressure chamber does not interfere with the arrangement of the connecting terminals compared to the case where the circulation liquid chamber overlaps the pressure chamber in a plan view. Therefore, the heat from the connecting terminal can be easily released to the circulation liquid chamber.

In the liquid ejecting head, a plurality of the circulation liquid chambers are formed in the flow passage forming section, and the connecting terminal overlaps at least one of the plurality of circulation liquid chambers in a plan view. In this case, since the plurality of circulation liquid chambers are formed in the flow passage forming section, the circulation amount of the ink can be increased. Moreover, since the connecting terminal overlaps at least one of the circulation liquid chambers in a plan view, the heat released from the connecting terminal to the circulation liquid chamber can be radiated on the flow of the ink in the plurality of circulation liquid chambers. Therefore, it is possible to improve the heat dissipation effect compared to the case where a single circulation liquid chamber is used.

According to another aspect of the invention, there is provided a liquid ejecting apparatus including the above-described liquid ejecting head. In this case, it is possible to provide the liquid ejecting apparatus including the liquid ejecting head that suppresses the change in the ejection characteristic caused by heat.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
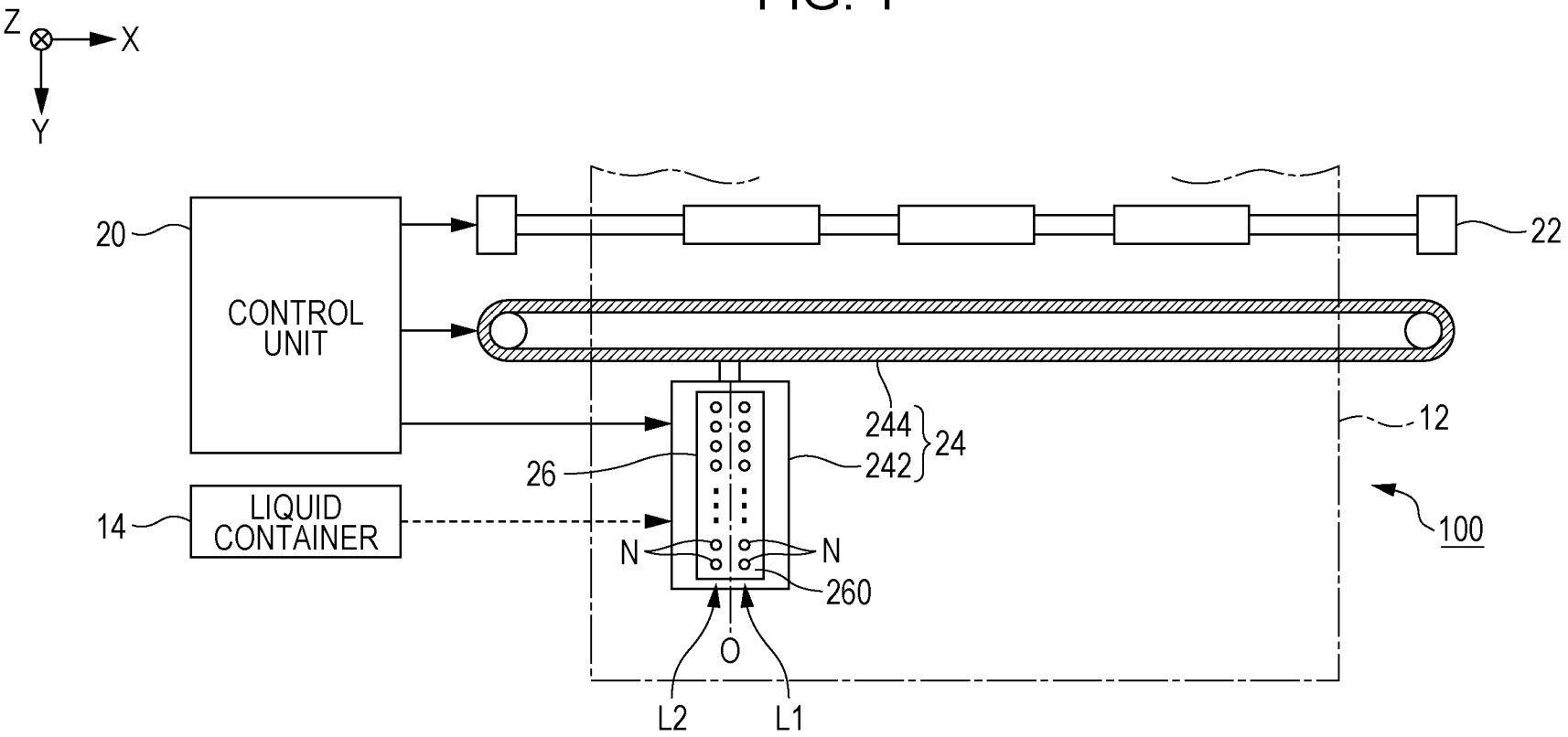
FIG. 1 is a structural diagram of a liquid ejecting apparatus according to an embodiment of the invention.

FIG. 1 is a partial structural diagram of a liquid ejecting apparatus 100 of according to a first embodiment of the invention. The liquid ejecting apparatus 100 of the first embodiment is an ink jet type printing apparatus that ejects ink, which is an example of liquid, on a medium 12 such as printing paper. The medium 12 is typically printing paper, but a printing target of any material such as a resin film or cloth may be used as the medium 12. The liquid ejecting apparatus 100 shown in FIG. 1 includes a control unit 20, a transport mechanism 22, a moving mechanism 24, and a liquid ejecting head 26. A liquid container 14 for storing ink is mounted in the liquid ejecting apparatus 100.

The liquid container 14 is an ink tank type cartridge made of a box-shaped container attachable and detachable to and from the main body of the liquid ejecting apparatus 100. The liquid container 14 is not limited to a box-shaped container, and may be an ink pack type cartridge made of a bag-shaped container. The liquid container 14 may be an ink tank capable of refilling ink. Ink is stored in the liquid container 14. The ink may be black ink, or color ink. The ink stored in the liquid container 14 is pressurized and fed to the liquid ejecting head 26 by a pump (not shown).

The control unit 20 includes a processing circuit such as a central processing unit (CPU) or a field programmable gate array (FPGA) and a memory circuit such as a semiconductor memory, and integrally controls each element of the liquid ejecting apparatus 100. The transport mechanism 22 transports the medium 12 in a Y direction under the control of the control unit 20.

The moving mechanism 24 reciprocates the liquid ejecting head 26 in an X direction under the control of the control unit 20. The X direction is a direction intersecting (typically orthogonal to) the Y direction in which the medium 12 is transported. The moving mechanism 24 of the first embodiment includes a substantially box-shaped carriage 242 (transport body) for storing the liquid ejecting head 26 and a transport belt 244 to which the carriage 242 is fixed. A configuration in which a plurality of the liquid ejecting heads 26 are installed on the carriage 242 or a configuration in which the liquid container 14 is installed on the carriage 242 together with the liquid ejecting head 26 may be adopted.

The liquid ejecting head 26 ejects the ink supplied from the liquid container 14 from a plurality of nozzles N (ejection hole) on the medium 12 under the control of the control unit 20. A desired image is formed on a surface of the medium 12 by the liquid ejecting head 26 ejecting ink on the medium 12 in parallel with transport of the medium 12 by the transport mechanism 22 and repetitive reciprocation of the carriage 242. A direction perpendicular to an X-Y plane (for example, a plane parallel to the surface of the medium 12) is defined as a Z direction. A direction in which ink is ejected by the liquid ejecting head 26 (typically, vertical direction) corresponds to the Z direction.

As shown in FIG. 1, the plurality of nozzles N of the liquid ejecting head 26 are formed on an ejection surface 260 (a surface facing the medium 12). The plurality of nozzles N are arranged in the Y direction. The plurality of nozzles N of the first embodiment are divided into a first nozzle row L1 and a second nozzle row L2 which are juxtaposed at intervals in the X direction. Each of the first nozzle row L1 and the second nozzle row L2 is a group of the plurality of nozzles N linearly arranged in the Y direction. It is possible to differentiate the position of each of the nozzles N between the first nozzle row L1 and the second nozzle row L2 in the Y direction (that is, staggered arrangement). However, hereinafter, a configuration in which the positions of each of the nozzles N in the Y direction are aligned in the first nozzle row L1 and the second nozzle row L2 will be described for the sake of convenience.

Liquid Ejecting Head

Figure 2:
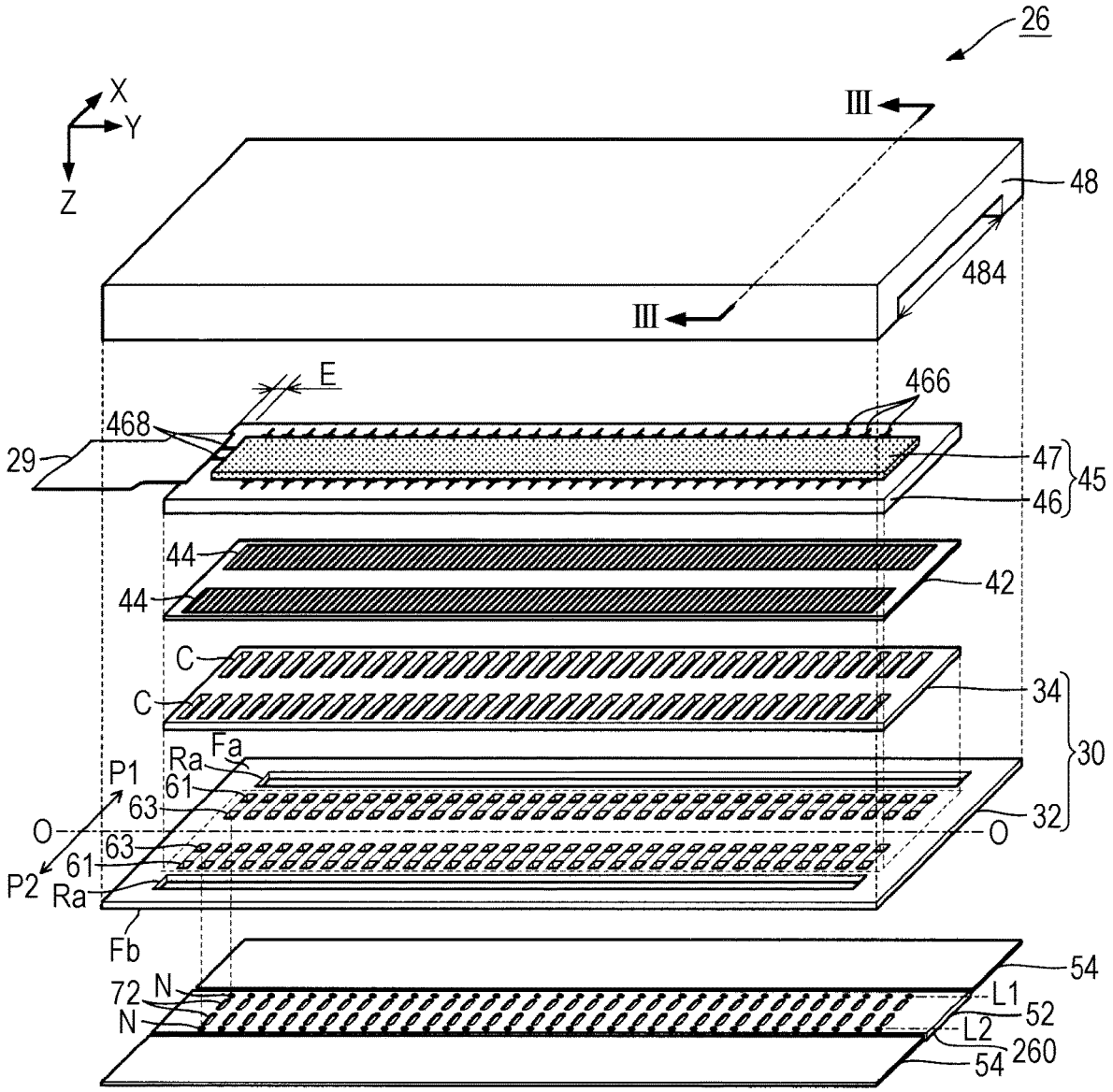
FIG. 2 is an exploded perspective view of a liquid ejecting head.
Figure 3:
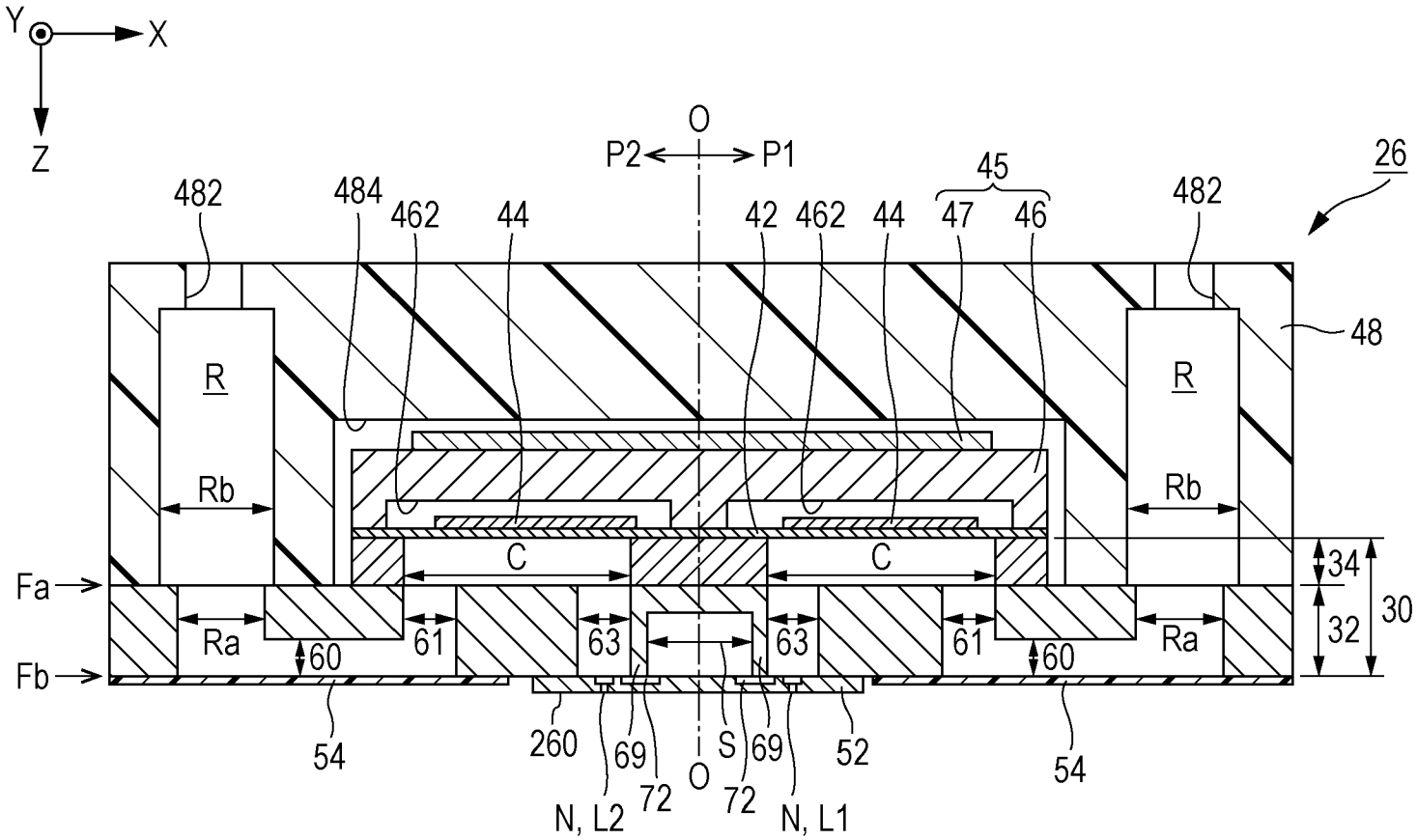
FIG. 3 is a sectional view of the liquid ejecting head taken along line III-III shown in FIG. 2.
Figure 4:
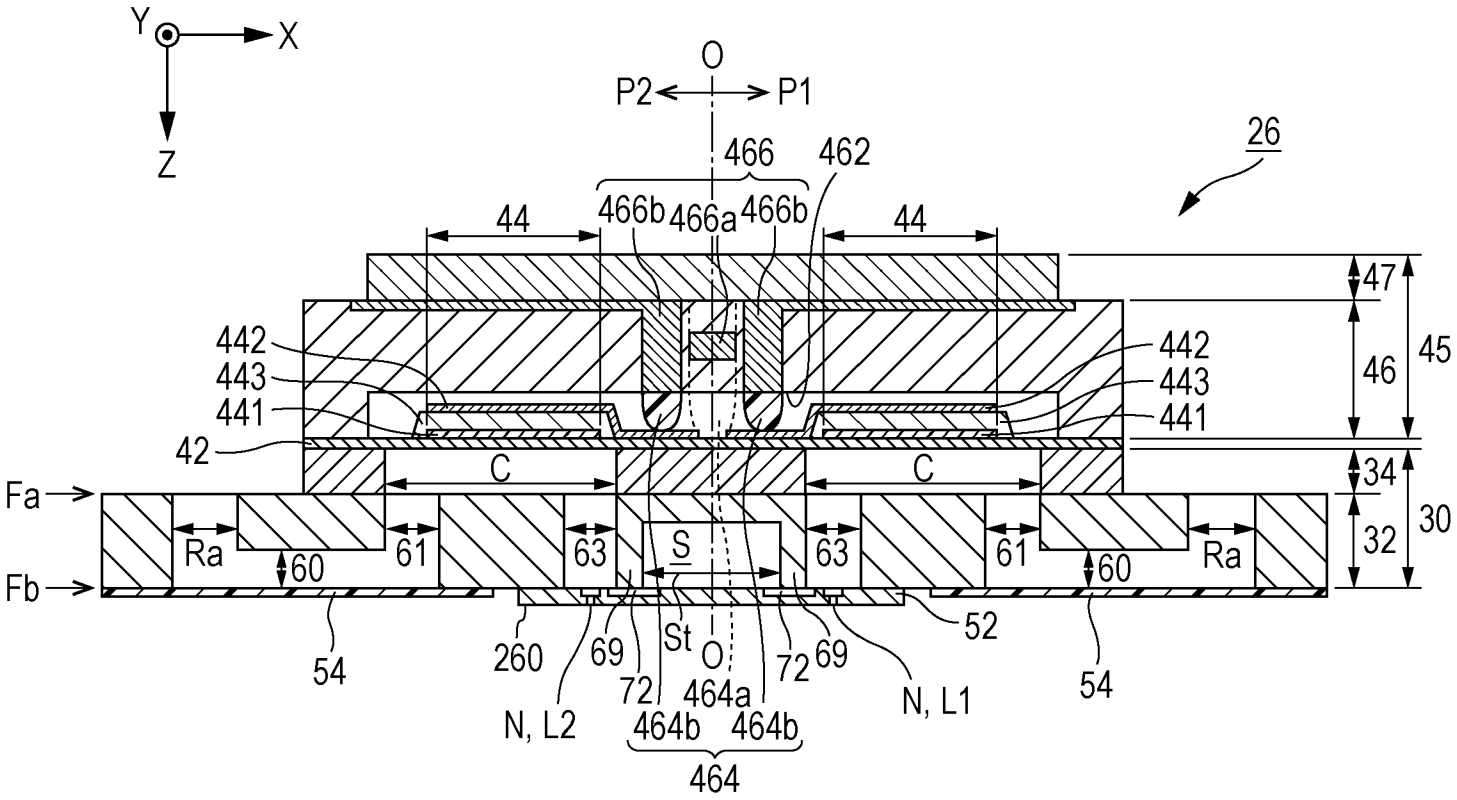
FIG. 4 is an enlarged sectional view of the liquid ejecting head shown in FIG. 3.

FIG. 2 is an exploded perspective view of the liquid ejecting head 26 and FIG. 3 is a sectional view of the liquid ejecting head 26 taken along line III-III perpendicular to the Y direction. FIG. 4 is an enlarged sectional view of the liquid ejecting head 26 shown in FIG. 3, and a housing portion 48 is omitted. O-O in the drawings is a plan (Y-Z plan) of the liquid ejecting head 26 parallel to the Z direction including a central axis parallel to the Y direction, and will be referred to as a central plane O-O in the following description. As shown in FIGS. 2 and 3, elements related to each of the nozzles N of the first nozzle row L1 (example of first nozzle) and elements of each of the nozzles N of the second nozzle row L2 (example of second nozzle) are disposed plane symmetrically interposing the central plane O-O therebetween in the liquid ejecting head 26 of the first embodiment. That is, interposing the central plane O-O therebetween, the configuration of a portion (hereinafter, referred to as "first portion") P1 on the positive side of the liquid ejecting head 26 in the X direction and the configuration of a portion (hereinafter, referred to as "second portion") P2 on the negative side of the liquid ejecting head 26 in the X direction are substantially common. The plurality of nozzles N of the first nozzle row L1 are formed in the first portion P1 and the plurality of nozzles N of the second nozzle row L2 are formed in the second portion P2. The central plane O-O corresponds to a boundary surface of the first portion P1 and the second portion P2.

The liquid ejecting head 26 includes a flow passage forming section 30. The flow passage forming section 30 is a structural body forming a flow passage to supply ink to the plurality of nozzles N. The flow passage forming section 30 of the first embodiment is formed by laminating a first flow passage substrate 32 (communicating plate) and a second flow passage substrate 34 (pressure chamber substrate). The first flow passage substrate 32 and the second flow passage substrate 34 are a plate-like member elongated in the Y direction, respectively. The second flow passage substrate 34 is bonded to a surface Fa (upper surface) of the first flow passage substrate 32 on the negative side in the Z direction with an adhesive and the like.

A vibration portion 42, a plurality of piezoelectric elements 44, a circuit board 45, and the housing portion 48 are installed on the surface Fa of the first flow passage substrate 32 in addition to the second flow passage substrate 34. On the other hand, a nozzle plate 52 and a vibration absorber 54 are installed on a surface Fb of the first flow passage substrate 32 on a positive side (that is, on the side opposite to the surface Fa) in the Z direction. Each element of the liquid ejecting head 26 is schematically a plate-like member elongated in the Y direction as the same as the first flow passage substrate 32 and the second flow passage substrate 34, and is bonded with an adhesive. Since each plate-like element forming the liquid ejecting head 26 of the present embodiment is laminated in the Z direction, which is a direction vertical to a surface of each of the plate-like element, for example, the lamination direction of the first flow passage substrate 32 and the second flow passage substrate 34 and the lamination direction of the first flow passage substrate 32 and the nozzle plate 52 correspond to the Z direction.

The nozzle plate 52 is a plate-like member on which the plurality of nozzles N are formed, and is bonded to the surface Fb of the first flow passage substrate 32 with an adhesive and the like. A surface of the nozzle plate 52 on a side opposite to the surface on the first flow passage substrate 32 side is the ejection surface 260 facing the medium 12. Each of the plurality of nozzles N is a cylindrical through-hole penetrating from the ejection surface 260 to the surface on the first flow passage substrate 32 side. The plurality of nozzles N forming the first nozzle row L1 and the plurality of nozzles N forming the second nozzle row L2 are formed in the nozzle plate 52 of the first embodiment. Specifically, the plurality of nozzles N of the first nozzle row L1 are formed along the Y direction in a region of the nozzle plate 52 on the positive side in the X direction as seen from the central plane O-O, and the plurality of nozzles N of the second nozzle row L2 are formed along the Y direction in a region of the nozzle plate 52 on the negative side in the X direction. The nozzle plate 52 of the first embodiment is a single plate-like member continuous over the portion in which the plurality of nozzles N of the first nozzle row L1 are formed and the portion in which the plurality of nozzles N of the second nozzle row L2 are formed. The nozzle plate 52 of the first embodiment is manufactured by processing a single crystal substrate made of silicon (Si) using a semiconductor manufacturing technique (processing technique such as dry etching or wet etching). A well-known material or a manufacturing method can be applied to the manufacturing of the nozzle plate 52.

As shown in FIGS. 2 and 3, a space Ra, a supply liquid chamber 60, a plurality of supply passages 61, and a plurality of communication passages 63 are formed in each of the first portion P1 and the second portion P2 in the first flow passage substrate 32. The space Ra is an opening elongated in the Y direction in a plan view (that is, as seen from the Z direction), and the supply passages 61 and the communication passages 63 are through-holes formed in each of the nozzles N. The supply liquid chamber 60 is a space formed elongatedly over the plurality of nozzles N along the Y direction, and makes the space Ra and the plurality of supply passages 61 mutually communicate with each other. The plurality of communication passages 63 are arranged in the Y direction in a plan view, and the plurality of supply passages 61 are arranged in the Y direction between the arrangement of the plurality of communication passages 63 and the space Ra. The plurality of supply passages 61 commonly communicate with the space Ra. A random one of the communication passages 63 overlaps one of the corresponding nozzles N in a plan view. Specifically, a random one of the communication passages 63 in the first portion P1 communicates with one of the nozzles N of the first nozzle row L1 corresponding to the random one of the communication passages 63. Similarly, a random one of the communication passages 63 in the second portion P2 communicates with one of the nozzles N of the second nozzle row L2 corresponding to the random one of the communication passages 63.

The second flow passage substrate 34 is a plate-like member in which a plurality of pressure chambers C (cavity) are formed in each of the first portion P1 and the second portion P2. The plurality of pressure chambers C are arranged in the Y direction. Each of the pressure chambers C is a space formed in each of the nozzles N elongated in the X direction in a plan view. Similar to the nozzle plate 52, the first flow passage substrate 32 and the second flow passage substrate 34 are manufactured by, for example, processing a single crystal substrate made of silicon using the semiconductor manufacturing technique. Any well-known material or a manufacturing method can be applied to the manufacturing of the first flow passage substrate 32 and the second flow passage substrate 34. As described above, the flow passage forming section 30 (first flow passage substrate 32 and second flow passage substrate 34) and the nozzle plate 52 of the first embodiment contains a substrate made of silicon. Therefore, for example, using the semiconductor manufacturing technique as exemplified above, it is possible to form a fine flow passage with high accuracy in the flow passage forming section 30 and the nozzle plate 52.

The vibration portion 42 is installed on a surface of the second flow passage substrate 34 on a side opposite to the first flow passage substrate 32. The vibration portion 42 of the first embodiment is an elastically vibratable plate-like member (vibration plate). It is possible to integrally form the second flow passage substrate 34 and the vibration portion 42 by selectively excluding a portion of a region corresponding to the pressure chambers C of the plate-like member having a certain thickness in the plate thickness direction.

The surface Fa of the first flow passage substrate 32 and the vibration portion 42 face each other with an interval therebetween inside each of the pressure chambers C. Each of the pressure chambers C is a space located between the surface Fa of the first flow passage substrate 32 and the vibration portion 42, and generates pressure change in the ink filled in the space. Each of the pressure chambers C is, for example, a space with the X direction as a longitudinal direction, and is individually formed in each of the nozzles N. The plurality of pressure chambers C are arranged in the Y direction in each of the first nozzle row L1 and the second nozzle row L2. In the configuration of FIGS. 2 and 3, an end portion of a random one of the pressure chambers C on the central plane O-O side overlaps the communication passages 63 in a plan view, and an end portion on a side opposite to the central plane O-O overlaps the supply passages 61 in a plan view. Therefore, the pressure chambers C communicate with the nozzles N via the communication passages 63 and communicate with the space Ra via the supply passages 61 in each of the first portion P1 and the second portion P2. A predetermined flow passage resistance may be added by forming a throttle flow passage narrowed in flow passage width in the pressure chambers C.

As shown in FIGS. 2 and 3, the plurality of piezoelectric elements 44 corresponding to different nozzles N are installed on a surface of the vibration portion 42 on a side opposite to the pressure chambers C in each of the first portion P1 and the second portion P2. The piezoelectric elements 44 are passive elements that deform by supply of a drive signal. The plurality of piezoelectric elements 44 are arranged in the Y direction so as to correspond to each of the pressure chambers C. When the vibration portion 42 is vibrated in conjunction with the deformation of the piezoelectric elements 44 to which the drive signal is supplied, the ink filled in the pressure chambers C is ejected through the communication passages 63 and the nozzles N due to the fluctuation in pressure in the pressure chambers C corresponding to the piezoelectric elements 44.

As shown in FIG. 4, a random one of the piezoelectric elements 44 is a laminated body in which a piezoelectric layer 443 is interposed between a first electrode 441 and a second electrode 442 facing each other. The portion where the first electrode 441, the second electrode 442, and the piezoelectric layer 443 overlap in a plan view functions as the piezoelectric elements 44. It is possible to define the portion deformed by the supply of the drive signal (that is, an active portion that vibrates the vibration portion 42) as the piezoelectric elements 44. One of the first electrode 441 and the second electrode 442 can be an electrode continuous over the plurality of piezoelectric elements 44 (that is a common electrode), and the other can be a separate individual electrode for each of the plurality of piezoelectric elements 44. In the present embodiment, a case in which the first electrode 441 is a common electrode and the second electrode 442 is an individual electrode will be exemplified. A wiring structure for driving the piezoelectric elements 44 will be described later.

The housing portion 48 shown in FIGS. 2 and 3 is a case member for storing ink to be supplied to the plurality of pressure chambers C (furthermore, the plurality of nozzles N). A surface of the housing portion 48 on the positive side of the Z direction is bonded to the surface Fa of the first flow passage substrate 32 with an adhesive and the like. The housing portion 48 is formed of a material different from the flow passage forming section 30. For example, the housing portion 48 can be manufactured by an injection molding of a resin material.

As shown in FIG. 3, a space Rb is formed in each of the first portion P1 and the second portion P2 in the housing portion 48 of the first embodiment. The space Rb of the housing portion 48 and the space Ra of the first flow passage substrate 32 communicate with each other. The space configured of the space Ra and the space Rb functions as a liquid storage chamber R (reservoir) for storing ink to be supplied to the plurality of pressure chambers C. The liquid storage chamber R is a common liquid chamber commonly used for the plurality of nozzles N. The liquid storage chamber R is formed in each of the first portion P1 and the second portion P2. The liquid storage chamber R of the first portion P1 is located on the positive side of the X direction as seen from the central plane O-O and the liquid storage chamber R of the second portion P2 is located on the negative side of the X direction seen from the central plane O-O. An inlet 482 for introducing the ink supplied from the liquid container 14 to the liquid storage chamber R is formed on a surface of the housing portion 48 on a side opposite to the first flow passage substrate 32. The liquid in the liquid storage chamber R is supplied to the pressure chambers C via the supply liquid chamber 60 and each of the supply passages 61.

The vibration absorber 54 is installed in each of the first portion P1 and the second portion P2 on the surface Fb of the first flow passage substrate 32. The vibration absorber 54 is a flexible film (compliance substrate) that absorbs pressure fluctuation of ink in the liquid storage chamber R. As shown in FIG. 3, the vibration absorber 54 is installed on the surface Fb of the first flow passage substrate 32 so as to close the space Ra of the first flow passage substrate 32 and the plurality of supply passages 61 and constitutes a wall surface (specifically, a bottom surface) of the liquid storage chamber R. A space constituting a circulation liquid chamber S is formed on the surface Fb of the first flow passage substrate 32 facing the nozzle plate 52. The circulation liquid chamber S of the first embodiment is an elongated bottomed hole (groove portion) extending in the Y direction in a plan view. The opening of the circulation liquid chamber S is closed by the nozzle plate 52 bonded to the surface Fb of the first flow passage substrate 32. The circulation liquid chamber S is a portion of a circulation flow passage for circulating liquid between the liquid storage chamber R and the circulation liquid chamber S.

Circulation Flow Passage

Figure 5:
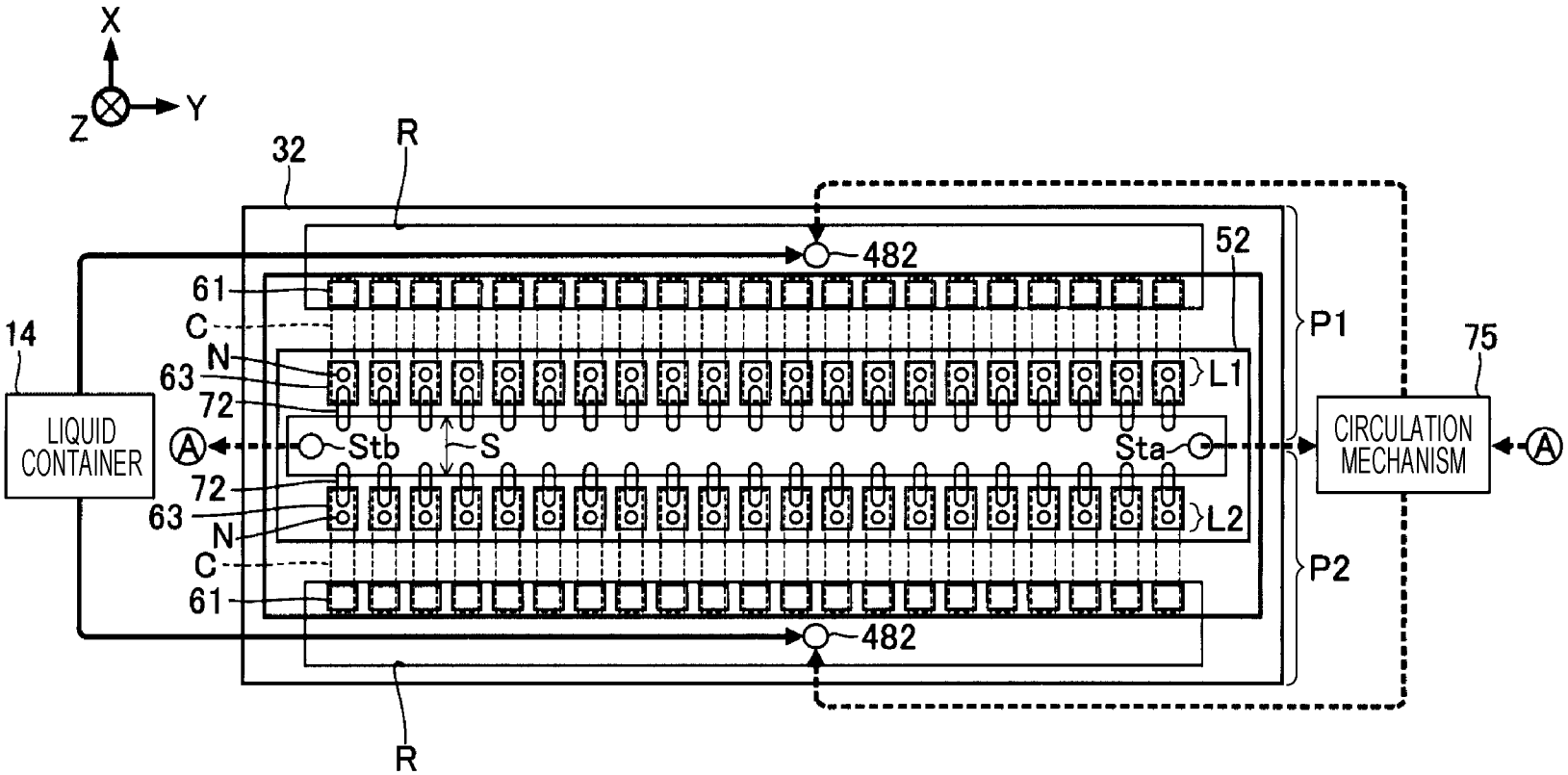
FIG. 5 is a structural diagram of the liquid ejecting head focused on a circulation liquid chamber.

Next, the configuration of the circulation flow passage by the circulation liquid chamber S of the present embodiment will be explained. FIG. 5 is a structural diagram of the liquid ejecting head 26 focused on the circulation liquid chamber S. As shown in FIG. 5, the circulation liquid chamber S is continuous over the plurality of nozzles N along the first nozzle row L1 and the second nozzle row L2. Specifically, the circulation liquid chamber S is formed between the nozzles N of the first nozzle row L1 and the nozzles N of the second nozzle row L2. Therefore, as shown in FIGS. 2 and 3, the circulation liquid chamber S is located between the communication passages 63 of the first portion P1 and the communication passages 63 of the second portion P2. Accordingly, the flow passage forming section 30 of the first embodiment is a structural body in which the pressure chambers C (first pressure chamber) and the communication passages 63 (first communication passage) of the first portion P1, the pressure chambers C (second pressure chamber) and the communication passages 63 (second communication passage) of the second portion P2, and the circulation liquid chamber S located between the communication passages 63 of the first portion P1 and the communication passages 63 of the second portion P2 are formed. The flow passage forming section 30 of the present embodiment includes a partition wall 69 that is a wall-like portion partitioning between the circulation liquid chamber S and each of the communication passages 63.

In the present embodiment, the plurality of pressure chambers C and the plurality of piezoelectric elements 44 are arranged in the Y direction in each of the first portion P1 and the second portion P2. Therefore, the circulation liquid chamber S extends in the Y direction to be continuous over the plurality of pressure chambers C or the plurality of piezoelectric elements 44 in each of the first portion P1 and the second portion P2. Moreover, the circulation liquid chamber S and the liquid storage chamber R extend in the Y direction with an interval therebetween in the X direction, and the pressure chambers C, the communication passages 63, and the nozzles N are located in the intervals in the X direction.

Figure 6:
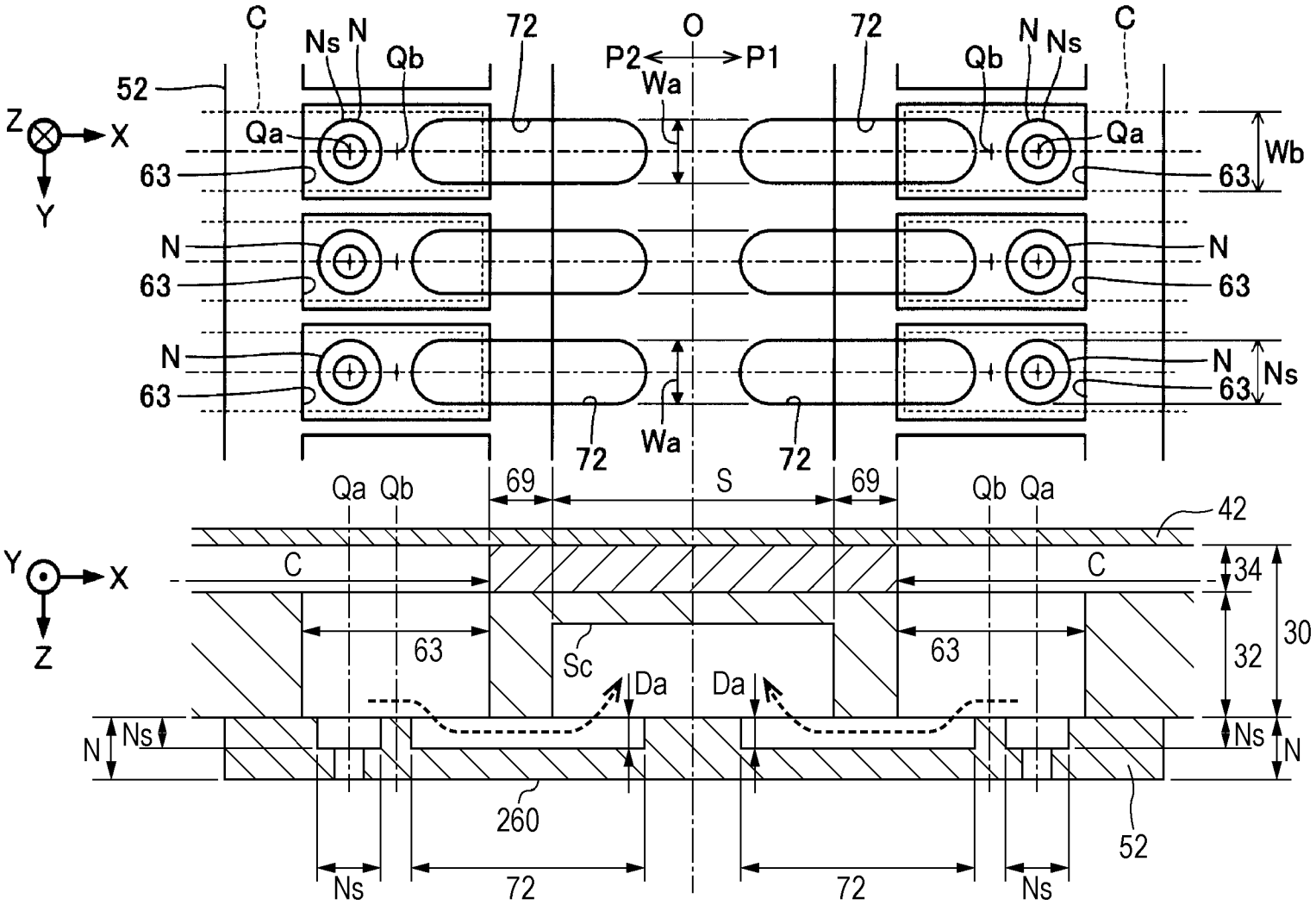
FIG. 6 is a plan view and a sectional view enlarging a portion in a vicinity of the circulation liquid chamber.

FIG. 6 is a plan view and a sectional view enlarging a portion of the liquid ejecting head 26 in a vicinity of the circulation liquid chamber S. As shown in FIG. 6, a central axis Qa of each of the nozzles N is located on a side opposite to the circulation liquid chamber S as seen from a central axis Qb of the communication passages 63. A plurality of circulation passages 72 are formed in each of the first portion P1 and the second portion P2 in a surface of the nozzle plate 52 facing the flow passage forming section 30. The plurality of circulation passages 72 of the first portion P1 (an example of a first circulation passage) correspond to the plurality of nozzles N of the first nozzle row L1 (or the plurality of communication passages 63 corresponding to the first nozzle row L1) in one to one. The plurality of circulation passages 72 of the second portion P2 (an example of a second circulation passage) correspond to the plurality of nozzles N of the second nozzle row L2 (or the plurality of communication passages 63 corresponding to the second nozzle row L2) in one to one.

Each of the plurality of nozzles N may be a through-hole penetrating from the ejection surface 260 to the surface of the nozzle plate 52 on the first flow passage substrate 32 side at the same diameter, or a through-hole having an enlarged diameter portion Ns in which the diameter increases on the way as shown FIG. 6. The enlarged diameter portion Ns of FIG. 6 is opened on a surface of the nozzle plate 52 on the first flow passage substrate 32 side, and has a diameter larger than the opening diameter of the nozzles N opened to the ejection surface 260. Accordingly, it becomes easier to set the flow passage resistance of each of the nozzles N to a desired characteristic by making each of the nozzles N a through-hole having the enlarged diameter portion Ns.

Each of the circulation passages 72 is a groove portion extending in the X direction (that is an elongated bottomed hole) and functions as a flow passage for circulating ink. The circulation passages 72 is formed at a position away from the nozzles N (specifically, on the circulation liquid chamber S side as seen from the nozzles N corresponding to the circulation passages 72). For example, the plurality of nozzles N and the plurality of circulation passages 72 are collectively formed through a common process by the semiconductor manufacturing technique (for example, processing technique such as dry etching or wet etching).

Each of the circulation passages 72 is linearly formed at a flow passage width Wa equivalent to that of the enlarged diameter portion of the nozzles N. The flow passage width (dimension in the Y direction) Wa of the circulation passages 72 in the first embodiment is smaller than a flow passage width (dimension in the Y direction) Wb of the pressure chambers C. Therefore, it is possible to increase the flow passage resistance of the circulation passages 72 compared to a configuration in which the flow passage width Wa of the circulation passages 72 is larger than the flow passage width Wb of the pressure chambers C. On the other hand, a depth Da of the circulation passages 72 with respect to the surface of the nozzle plate 52 is constant over the entire length and is formed at a depth equivalent to that of the enlarged diameter portion Ns of the nozzles N. Therefore, it becomes easier to form the circulation passages 72 and the enlarged diameter portion of the nozzles N compared to a configuration in which the circulation passages 72 and the enlarged diameter portion Ns of the nozzles N are formed at different depths. "Depth" of the flow passage means the depth of the flow passage in the Z direction (for example, difference in height between formation surface of the flow passage and the bottom surface of the flow passage).

A random one of the circulation passages 72 in the first portion P1 is located on the circulation liquid chamber S side as seen from one of the nozzles N of the first nozzle row L1 corresponding to the random one of the circulation passages 72. A random one of the circulation passages 72 in the second portion P2 is located on the circulation liquid chamber S side as seen from one of the nozzles N of the second nozzle row L2 corresponding to the random one of the circulation passages 72. An end portion of each of the circulation passages 72 on a side opposite to the central plane O-O (communication passages 63 side) overlaps one of the communication passages 63 corresponding to the circulation passages 72 in a plan view. That is, the circulation passages 72 communicates with the communication passages 63. On the other hand, an end portion of each of the circulation passages 72 on the central plane O-O side (circulation liquid chamber S side) overlaps the circulation liquid chamber S in a plan view. That is, the circulation passages 72 communicates with the circulation liquid chamber S. As shown in the above description, each of the plurality of communication passages 63 communicates with the circulation liquid chamber S via the circulation passages 72. Therefore, as indicated by a dashed arrow in FIG. 6, the ink in each of the communication passages 63 is supplied to the circulation liquid chamber S via the circulation passages 72. That is, in the first embodiment, the plurality of communication passages 63 corresponding to the first nozzle row L1 and the plurality of communication passages 63 corresponding to the second nozzle row L2 commonly communicate with a single circulation liquid chamber S.

Accordingly, in the circulation flow passage of the present embodiment, the pressure chambers C indirectly communicate with the circulation liquid chamber S via the communication passages 63 and the circulation passages 72. According to the configuration, when the pressure in the pressure chambers C fluctuates due to the operation of the piezoelectric elements 44, a portion of the ink flow in the communication passages 63 is ejected from the nozzles N to the outside, and the remaining portion flows into the circulation liquid chamber S from the communication passages 63 through the circulation passages 72. In the present embodiment, for example, the inertance of the communication passages 63, the nozzles, and the circulation passages 72 is selected such that an amount of ink ejected via the nozzles N (hereinafter, referred to as "ejection amount") of the ink flowing through the communication passages 63 by a single drive of the piezoelectric elements 44 exceeds an amount of ink flow into the circulation liquid chamber S via the circulation passages 72 (hereinafter, referred to as "circulation amount") of the ink flowing through the communication passages 63.

A circulation mechanism 75 shown in FIG. 5 is a mechanism for supplying (that is, circulating) the ink in the circulation liquid chamber S to the liquid storage chamber R. The circulation mechanism 75 includes, for example, a suction mechanism (such as pump) for sucking ink from the circulation liquid chamber S, a filter mechanism for collecting bubbles and foreign matters mixed in the ink, and a heating mechanism for reducing viscosity by heating the ink (not shown). The ink in which bubbles and foreign matters are removed by the circulation mechanism 75 and the viscosity is reduced is supplied from the circulation mechanism 75 to the liquid storage chamber R via the inlet 482. Therefore, in the first embodiment, the ink circulates in the following passage: liquid storage chamber R→supply passages 61→pressure chambers C→communication passages 63→circulation passages 72→circulation liquid chamber S→circulation mechanism 75→liquid storage chamber R.

The circulation mechanism 75 sucks ink from both sides of the circulation liquid chamber S in the Y direction. In the circulation liquid chamber S, a circulation port Sta located in the vicinity of the end portion on the positive side in the Y direction and a circulation port Stb located in the vicinity of the end portion on the negative side in the Y direction are formed. The circulation mechanism 75 sucks ink from both the circulation port Sta and the circulation port Stb. In a configuration in which ink is sucked from only one end portion of the circulation liquid chamber S in the Y direction, difference in pressure of ink occurs between both end portions of the circulation liquid chamber S, and the pressure of the ink in the communication passages 63 may differ depending on the position in the Y direction due to the difference in pressure in the circulation liquid chamber S. Therefore, there is a possibility that the ejection characteristic (such as ejection amount or ejection speed) of ink from each of the nozzles N may differ depending on the position in the Y direction. In contrast to the above-described configuration, since ink is sucked from both sides (circulation port Sta and circulation port Stb) of the circulation liquid chamber S, the difference in pressure inside the circulation liquid chamber S is reduced in the first embodiment. Therefore, it is possible to approximate the ejection characteristic of ink with high accuracy over the plurality of nozzles N arranged in the Y direction. However, in a case where the difference in pressure in the circulation liquid chamber S in the Y direction does not cause a particular problem, the configuration in which the ink is sucked from one end portion of the circulation liquid chamber S may be applied.

The circulation passages 72 overlap the communication passages 63 in a plan view, the communication passages 63 overlap the pressure chambers C in a plan view, and the circulation passages 72 and the pressure chambers C overlap each other in a plan view. On the other hand, the circulation liquid chamber S and the pressure chambers C do not overlap each other in a plan view. Since the piezoelectric elements 44 are formed over the entire the pressure chambers C along the X direction, the circulation passages 72 and the piezoelectric elements 44 overlap each other in a plan view and the circulation liquid chamber S and the piezoelectric elements 44 do not overlap each other in a plan view. According to the above-described configuration, since the pressure chambers C or the piezoelectric elements 44 overlap the circulation passages 72 in a plan view, and do not overlap the circulation liquid chamber S in a plan view, it is easier to downsize the liquid ejecting head 26 compared to the configuration in which the pressure chambers C or the piezoelectric elements 44 do not overlap the circulation passages 72 in a plan view, for example.

Since the circulation passages 72 that communicate the communication passages 63 and the circulation liquid chamber S are formed on the nozzle plate 52, it is possible to circulate the ink in the vicinity of the nozzles N to the circulation liquid chamber S more efficiently compared to the case where the circulation communication passages are formed on the first flow passage substrate 32 (communicating plate). Moreover, in the first embodiment, the communication passages 63 corresponding to the first nozzle row L1 and the communication passages 63 corresponding to the second nozzle row L2 commonly communicate with the circulation liquid chamber S interposed therebetween. Therefore, since the configuration of the liquid ejecting head 26 can be simplified compared to the configuration in which the circulation liquid chamber S communicating with each of the circulation passages 72 corresponding to the first nozzle row L1 and the circulation liquid chamber S communicating with each of the circulation passages 72 corresponding to the second nozzle row L2 are separately provided, it is possible to downsize the liquid ejecting head 26.

Circuit Board

The circuit board 45 shown in FIGS. 3 and 4 is configured of a protective member 46 laminated on the flow passage forming section 30 and a driving IC 47. In the circuit board 45 of the present embodiment, a case of installing the driving IC 47 on the protective member 46 and providing wirings between the driving IC 47 and the piezoelectric elements 44 in the protective member 46 will be exemplified. The protective member 46 is a plate-like member for protecting the plurality of piezoelectric elements 44, and is installed on a surface of the vibration portion 42 (or a surface of the second flow passage substrate 34). A groove-shaped recessed portion 484 extending in the Y direction is formed in a surface of the housing portion 48 on the positive side in the Z direction, and the protective member 46 and the driving IC 47 are stored inside the recessed portion 484.

Although any material and manufacturing method of the protective member 46 can be used, it is possible to form the protective member 46 by, for example, processing a single crystal substrate made of silicon (Si) using a semiconductor manufacturing technique similar to the first flow passage substrate 32 and the second flow passage substrate 34. The plurality of piezoelectric elements 44 are stored in the recessed portion formed on the surface of the protective member 46 on the vibration portion 42 side. The space surrounded by the recessed portion of the protective member 46 and the vibration portion 42 constitutes an installation space 462 of the piezoelectric elements 44. The protective member 46 can protect the piezoelectric elements 44 from moisture, impact from the outside, and the like by sealing the installation space 462 of the piezoelectric elements 44.

The driving IC 47 is mounted on a surface (mounting surface) of the protective member 46 on a side opposite to the vibration portion 42 side. The driving IC 47 is a substantially rectangular IC chip provided with a drive circuit for driving the plurality of piezoelectric elements 44. The driving IC 47 drives each of the piezoelectric elements 44 by generating and supplying drive signals of the piezoelectric elements 44 under the control of the control unit 20. At least a portion of the piezoelectric elements 44 of the liquid ejecting head 26 overlaps the driving IC 47 in a plan view. As shown in FIG. 4, in the protective member 46 of the present embodiment, a plurality of connecting terminals 464 and wirings 466 for electrically connecting the driving IC 47 and each of the piezoelectric elements 44 are provided, and the protective member 46 functions as a wiring substrate on which a driving IC is mounted.

Wiring Structure for Driving Piezoelectric Element

Figure 7:
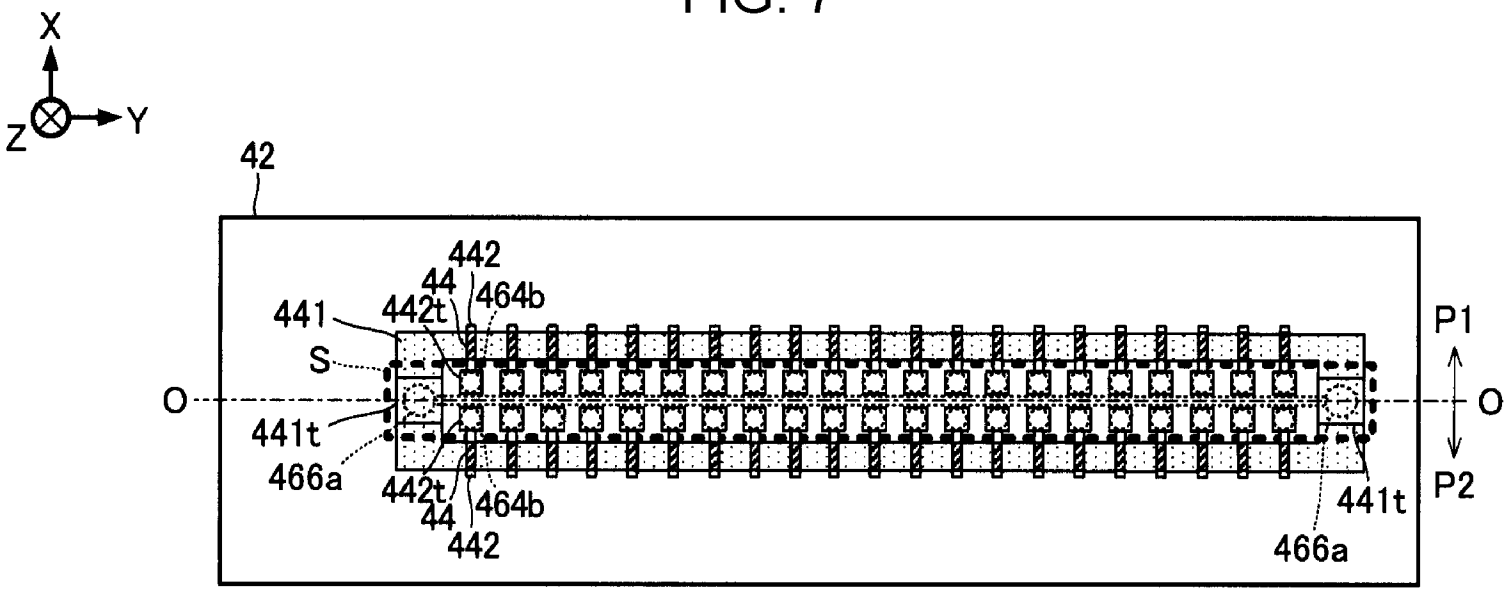
FIG. 7 is a plan view of a vibration portion and piezoelectric elements as seen from above.
Figure 8:
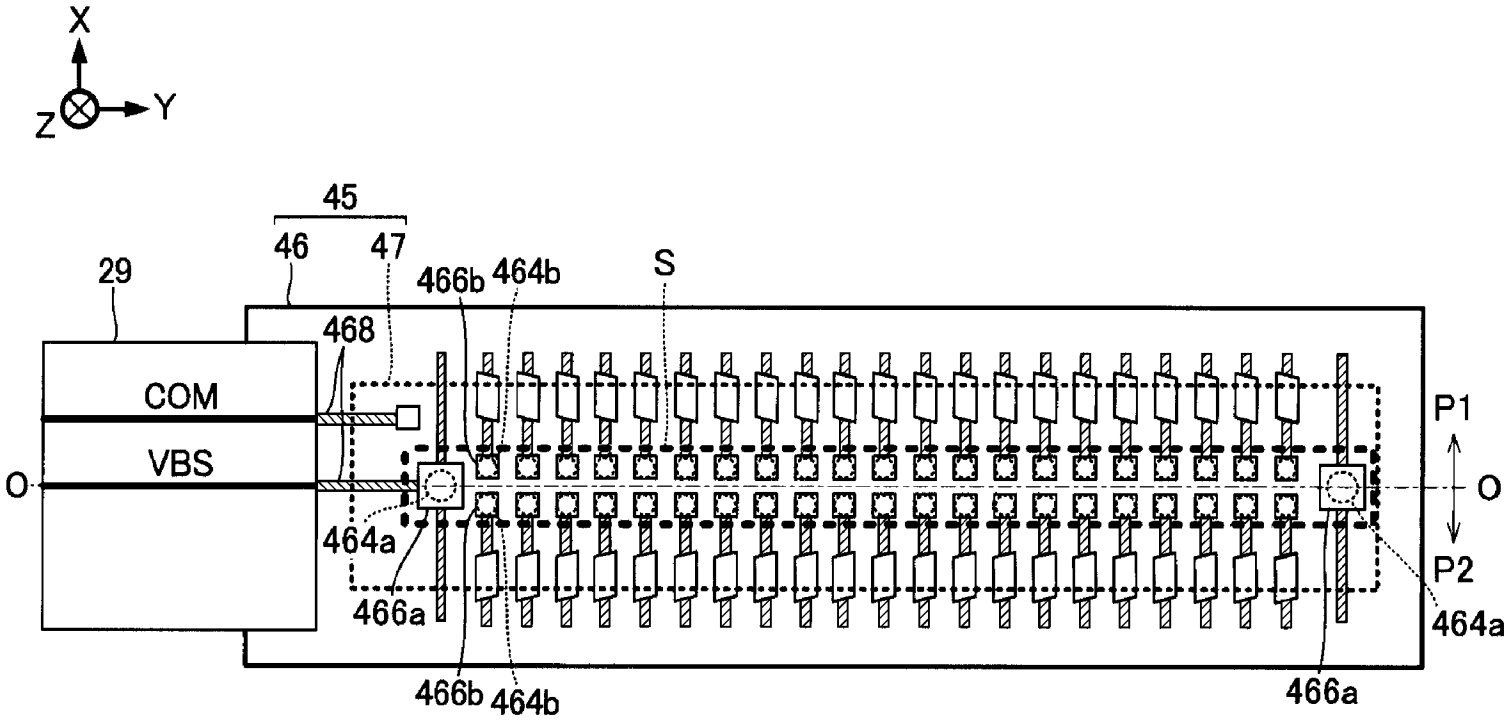
FIG. 8 is a plan view of a protective member as seen from above.

Here, the wiring structure of the liquid ejecting head 26 for driving the piezoelectric elements 44 will be described. FIGS. 7 and 8 are explanatory views on the wiring structure for driving the piezoelectric elements 44 of the present embodiment. FIG. 7 is a plan view of the vibration portion 42 and the piezoelectric elements 44 as seen from the Z direction (above). FIG. 8 is a plan view of the protective member 46 as seen from the Z direction (above). In the present embodiment, a first piezoelectric element and a second piezoelectric element are provided. In FIG. 7, the plurality of piezoelectric elements 44 arranged on one side in the X direction as seen from the central plane O-O (such as first portion P1 side) correspond to the first piezoelectric element, and the plurality of piezoelectric elements 44 arranged on the other side in the X direction as seen from the central plane O-O (such as the second portion P2 side) correspond to the second piezoelectric element.

As shown in FIGS. 4 and 8, the wirings 466 formed in the protective member 46 are divided into wiring 466*a* and wiring 466*b*. The connecting terminals 464 are divided into the connecting terminal 464*a* electrically connected to the wiring 466*a* and the connecting terminal 464*b* electrically connected to the wiring 466*b*. The wiring 466*a* is a wiring connected to an output terminal of a base voltage VBS of the driving IC 47 and are formed continuously in the Y direction along the arrangement of the piezoelectric elements 44. Specifically, the wiring 466*a* is formed of a wiring (conduction hole) in the Z direction at one end on the negative side in the Y direction and a wiring (conduction hole) on the other end on the positive side in the Y direction penetrating the protective member 46, and a wiring extending in the Y direction in the protective member 46 to connect a wiring at one end of the wiring 466*a* and a wiring at the other end of the wiring 466*a*.

The wiring 466*b* is a wiring connected to an output terminal of drive signal (drive voltage) COM of the driving IC 47, and is connected to each of the plurality of piezoelectric elements 44 one by one. Specifically, each of a plurality of the wirings 466*b* corresponding to the plurality of piezoelectric elements 44 constituting the first piezoelectric element and a plurality of the wirings 466*b* corresponding to the plurality of piezoelectric elements 44 constituting the second piezoelectric element are arranged in the Y direction. Each wiring 466*b* is formed of a wiring (conduction hole) that penetrates the protective member 46 in the Z direction and a wiring that communicates with the wiring, extends in the protective member 46 in the X direction, and is connected to a terminal (not shown) of the driving IC 47.

The connecting terminal 464*a* connects a terminal 441*t* of the first electrode 441 which is a common electrode of each of the piezoelectric elements 44 and the wiring 466*a*. Accordingly, the first electrode 441 of each of the piezoelectric elements 44 is connected to the output terminal of the base voltage VBS of the driving IC 47 via the connecting terminal 464*a* and the wiring 466*a*. Thereby, the base voltage VBS output from the output terminal of the driving IC 47 is applied to the first electrode 441 of each of the piezoelectric elements 44 via the wiring 466*a* and the connecting terminal 464*a*.

The connecting terminal 464*b* connects a terminal 442*t* of the second electrode 442 which is an individual electrode of each of the piezoelectric elements 44 and the wiring 466*b*. Accordingly, the second electrode 442 of each of the piezoelectric elements 44 is connected to an output terminal of the drive signal COM of the driving IC 47 via the connecting terminal 464*b* and the wiring 466*b*. Therefore, the drive signal COM output from the output terminal of the driving IC 47 is applied to the second electrode 442 of each of the piezoelectric elements 44 via the connecting terminal 464*b* and the wiring 466*b*.

As shown in FIG. 4, each of the connecting terminals 464*a* and 464*b* is formed of, for example, a resin core bump in which a projection formed of a resin material is covered with a conductive material. However, the connecting terminals 464*a* and 464*b* are not limited to a resin core bump, and may be formed of, for example, a metal bump. The terminal of the driving IC 47 and each wiring 466*b* may be connected with a resin core bump similar to the connecting terminals 464*a* and 464*b*, or may be connected with a metal bump.

As shown in FIGS. 7 and 8, the terminal 442*t* of the second electrode 442 of a random one of the piezoelectric elements 44 among the plurality of piezoelectric elements 44 constituting the first piezoelectric element is connected to one connecting terminal 464*b* corresponding to the random one of the piezoelectric elements 44 among the plurality of connecting terminals 464 on the first portion P1 side. The terminal 442*t* of the second electrode 442 of a random one of the piezoelectric elements 44 among the plurality of piezoelectric elements 44 constituting the second piezoelectric element is connected to one connecting terminal 464*b* corresponding to the random one of the piezoelectric elements 44 among the plurality of connecting terminals 464 on the second portion P2 side. The terminal 441*t* of the first electrode 441 of the piezoelectric elements 44 is connected to the connecting terminal 464*a*.

As shown in FIG. 2, a plurality of wirings 468 including wirings of the drive signal COM and the base voltage VBS connected to an input terminal of the driving IC 47 are formed in the protective member 46. The plurality of wirings 468 extend to a region E located at an end portion of the mounting surface of the protective member 46 in the Y direction (that is, the direction in which the plurality of piezoelectric elements 44 are arranged). A wiring member 29 is bonded in the region E. The wiring member 29 is a mounting component in which a plurality of wirings (not shown) for electrically connecting the control unit 20 and the driving IC 47 are formed. For example, a flexible wiring substrate such as a flexible printed circuit (FPC) and a flexible flat cable (FFC) is suitably applied as the wiring member 29. As described above, the protective member 46 of the present embodiment functions as a wiring substrate in which the wirings 466 and 468 for transmitting drive signals are formed. However, it is also possible to mount the driving IC 47 or to install the wiring substrate used for forming the wirings separately from the protective member 46.

In the liquid ejecting head 26 according to the present embodiment configured as described above, since at least a portion of the piezoelectric elements 44 overlaps the driving IC 47 in a plan view, the driving IC 47 including the drive circuit is installed near the piezoelectric elements 44. Therefore, since the length of the passage from the drive circuit to the piezoelectric elements 44 is shortened compared to a configuration in which a flexible wiring substrate on which the drive circuit is mounted is bonded to an electrode terminal of the piezoelectric elements 44, for example, it is possible to downsize and reduce the signal distortion caused by the resistance component and the capacitance component of the passage.

However, current flows in the wirings 466 and the connecting terminals 464 by driving the piezoelectric elements 44, and thereby the wirings 466 and the connecting terminals 464 generate heat, and the driving IC 47 also generates heat. Therefore, the closer the circuit board 45 is installed to the piezoelectric elements 44, the more heat is transmitted via the wirings 466 and the connecting terminals 464, and the heat is likely to be accumulated in the installation space 462 of the piezoelectric elements 44 surrounded by the circuit board 45 and the second flow passage substrate 34 (pressure chamber substrate). Accordingly, when the heat is accumulated in the installation space 462, the characteristics of the piezoelectric elements 44 change due to the influence of the heat, and there is a possibility that the ejection characteristic is changed. Moreover, there is a possibility that the ejection characteristic is changed due to the malfunction of the driving IC 47 caused by increase in temperature by the heat generated by the driving IC 47.

In the present embodiment, the position of the connecting terminals 464 with respect to the circulation liquid chamber S is devised to improve heat dissipation efficiency of the heat from the connecting terminals 464, so that the heat from the connecting terminals 464 is not accumulated in the installation space 462 of the piezoelectric elements 44. Specifically, as shown in FIG. 4, the connecting terminals 464 are disposed so as to overlap the circulation liquid chamber S in a plan view (plan view from the Z direction), so that the heat from the connecting terminals 464 can be efficiently released to the circulation liquid chamber S.

If the connecting terminals 464 are disposed at positions away from the circulation liquid chamber S so that the connecting terminals 464 do not overlap the circulation liquid chamber S in a plan view, since the heat from the connecting terminals 464 is hard to be released, and thereby, the heat tends to spread and accumulate in the entire installation space 462 of the piezoelectric elements 44. From this point, in the present embodiment, the connecting terminals 464 are disposed at positions close enough to overlap the circulation liquid chamber S in a plan view, so that the heat from the connecting terminals 464 can be efficiently released to the circulation liquid chamber S before the heat is spread to the entire installation space 462 of the piezoelectric elements 44.

According to the configuration of the present embodiment, since the heat from the connecting terminals 464 can be released to the circulation liquid chamber S, it is possible to suppress the increase in temperature of the drive circuit, and to protect the piezoelectric elements 44 from the heat.

Therefore, it is possible to suppress the change in the characteristics of the piezoelectric elements 44 due to heat and to suppress the malfunction of the drive circuit due to the increase in heat, so that it is possible to suppress the change in the ejection characteristic due to the heat. Since the viscosity of the ink in the flow passage decreases and the flow rate increases by the radiation of heat to the circulation liquid chamber S, it is possible to improve the circulation effect of ink such as bubble dischargeability. Since the viscosity of the ink in the flow passage decreases and the flow rate increases by the radiation of heat to the circulation liquid chamber S, it is possible to downsize the flow passage, so that the downsizing of the liquid ejecting head 26 is possible. In the present embodiment, the driving IC 47 is bonded via the protective member 46 laminated on the flow passage forming section 30, and the driving IC 47 and each of the piezoelectric elements 44 are connected by the connecting terminals 464 via the wiring of the protective member 46. Therefore, since the mounting load of the drive circuit on the flow passage forming section 30 can be reduced compared to the case where the flexible wiring substrate provided with the drive circuit for each of the piezoelectric elements 44 is connected to the flow passage forming section 30, it is possible to reduce the possibility of cracks occurring in the flow passage forming section 30.

Hereinafter, the positions of the connecting terminals 464 with respect to the circulation liquid chamber S will be described more specifically. As shown in FIGS. 7 and 8, all the connecting terminal 464*a* and the connecting terminal 464*b* of the present embodiment overlap the circulation liquid chamber S so as to be included in a formation region of the circulation liquid chamber S (inside regions surrounded by bold dotted lines in FIGS. 7 and 8) in a plan view. Accordingly, since all the connecting terminal 464*a* and the connecting terminal 464*b* are included in the formation region of the circulation liquid chamber S in a plan view, the heat from each of the connecting terminals 464*a* and 464*b* is radiated to the circulation liquid chamber S, so that it is possible to increase the heat dissipation efficiency. At least a portion of the connecting terminal 464*a* and the connecting terminal 464*b* may be included in the formation region of the circulation liquid chamber S. For example, only one of the connecting terminal 464*a* and the connecting terminal 464*b* may be included in the formation region of the circulation liquid chamber S, or a portion of a random one of the connecting terminal 464*a* and the connecting terminal 464*b* may be included in the formation region of the circulation liquid chamber S.

Since the circulation liquid chamber S of the present embodiment does not overlap the pressure chambers C in a plan view, the pressure chambers C does not interfere with the arrangement of the connecting terminals 464 compared to the case where the circulation liquid chamber S overlaps the pressure chambers C in a plan view, so that it is easier to bring the connecting terminals 464 close to the circulation liquid chamber S. Therefore, the heat from the connecting terminals 464 can be easily released to the circulation liquid chamber S. Moreover, the flow passage forming section 30 of the present embodiment includes the first flow passage substrate 32 in which the circulation liquid chamber S is formed and the second flow passage substrate 34 bonded to the first flow passage substrate 32 and in which the pressure chambers C is formed, and the connecting terminals 464 are disposed on a side of the second flow passage substrate 34 opposite to the first flow passage substrate 32, so that the heat from the connecting terminals 464 can be easily released to the circulation liquid chamber S of the first flow passage substrate 32 via the second flow passage substrate 34.

As in the present embodiment, since the heat from the connecting terminals 464 tends to be transmitted to the circulation liquid chamber S by forming the first flow passage substrate 32 and the second flow passage substrate 34 with the single crystal substrate made of silicon (Si) having high thermal conductivity, it is possible to improve the heat dissipation efficiency. A portion of the first flow passage substrate 32 and the second flow passage substrate 34 may have higher thermal conductivity than the other portions. For example, a portion of the first flow passage substrate 32 and the second flow passage substrate 34 overlapping at least the circulation liquid chamber S in a plan view may have the thermal conductivity higher than the other portions, or a portion or all the connecting terminals 464 may overlap the region having high thermal conductivity in a plan view. According to the configuration, it is possible to make the heat from the connecting terminals 464 easily escape from the region of the first flow passage substrate 32 and the second flow passage substrate 34 having higher thermal conductivity to the circulation liquid chamber S, and make the heat in the other portions difficult to be released, so that heat dissipation efficiency can be improved.

Since the circuit board 45 of the present embodiment is formed by installing the driving IC 47 in the protective member 46 and the wirings between the driving IC 47 and the piezoelectric elements 44 are provided in the protective member 46, it is possible to release the heat from the connecting terminals 464 to the circulation liquid chamber S via the wirings 466 of the protective member 46 while protecting the piezoelectric elements 44 with the protective member 46. Moreover, in the configuration in which the installation space 462 of the piezoelectric elements 44 is sealed with the protective member 46, the heat easily accumulates in the sealed installation space 462 of the piezoelectric elements 44. From this point, in the present embodiment, since it is possible to efficiently release the heat from the connecting terminals 464 to the circulation liquid chamber S, even if the installation space 462 of the piezoelectric elements 44 is sealed with the protective member 46, it is possible to make the heat difficult to accumulate in the installation space 462 of the piezoelectric elements 44.

In the present embodiment, as shown in FIG. 4, the case where the shape of the cross section (cross section taken along X-Z plane intersecting the Y direction in which the circulation liquid chamber S extends) of the circulation liquid chamber S is a rectangular in which a width St in the X direction does not change in the Z direction (height direction) is exemplified, but the invention is not limited thereto. For example, as the circulation liquid chamber S shown in FIG. 9 or 10, the circulation liquid chamber may include a portion where the width St of the circulation liquid chamber S is narrowed as getting closer to a surface of the flow passage forming section 30 on the connecting terminals 464 side (the surface Fa of the first flow passage substrate 32 or a surface of the second flow passage substrate 34 on the negative side in the Z direction). According to the configuration, it is possible to release the heat of the connecting terminals 464 to the circulation liquid chamber S while suppressing the decrease in the strength of the flow passage forming section 30.

Figure 9:
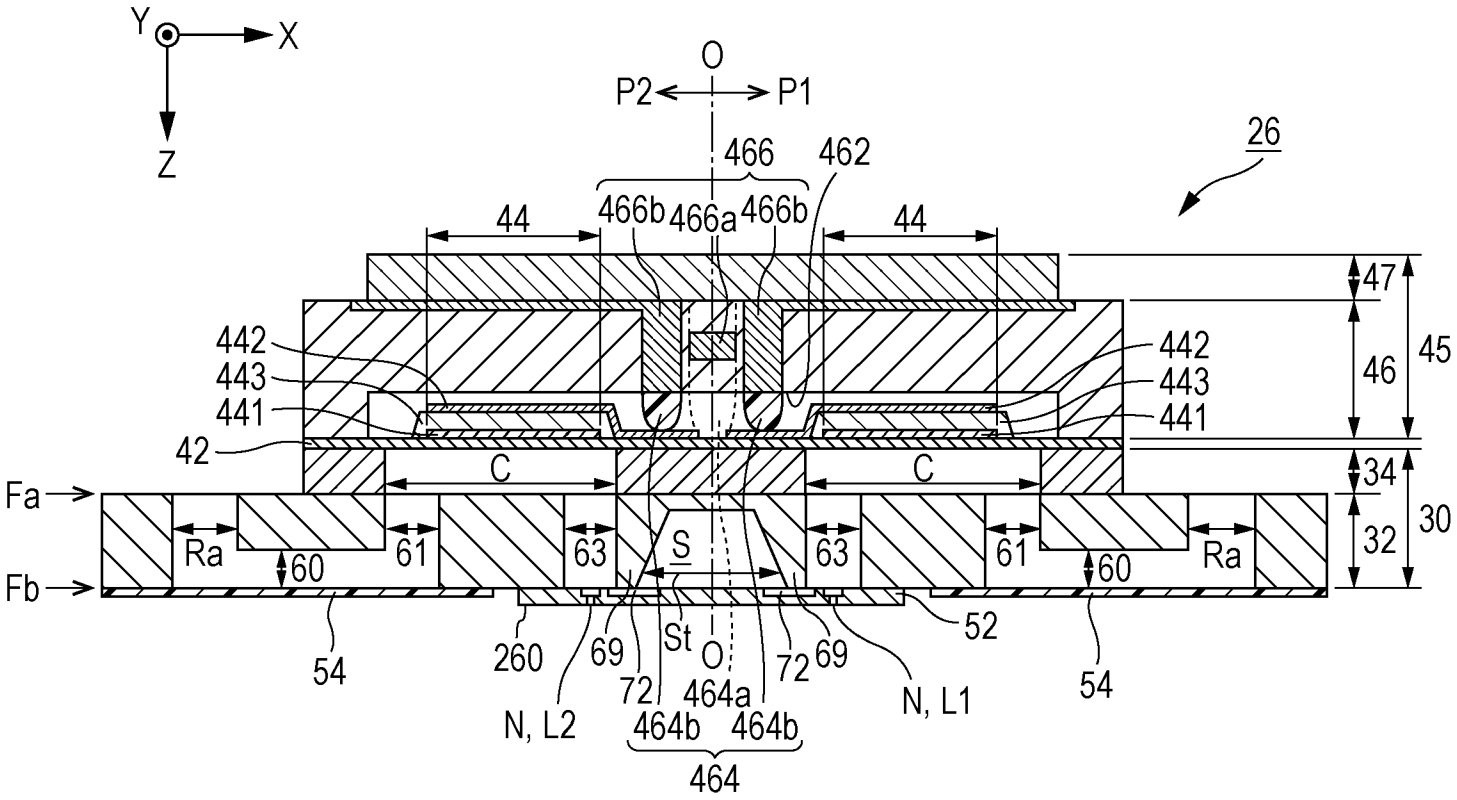
FIG. 9 is a sectional view showing a configuration of a liquid ejecting head according to a first modification example.

FIG. 9 is a sectional view showing a configuration of a liquid ejecting head 26 according to a first modification example and corresponds to FIG. 4. In the liquid ejecting head 26 of FIG. 9, the case where the circulation liquid chamber includes an inclined surface (oblique portion of trapezoid) where the width St of the above-described cross section is narrowed as getting closer to the surface of the flow passage forming section 30 on the connecting terminals 464 side by making the shape of the above-described cross section of the circulation liquid chamber S to be trapezoidal is exemplified. According to the configuration, it is possible to bring the circulation liquid chamber S close to the connecting terminals 464 while suppressing the decrease in the strength of the flow passage forming section 30. Therefore, it is possible to make the heat of the connecting terminals 464 easy to escape to the circulation liquid chamber S while suppressing the occurrence of the cracks in the flow passage forming section 30.

Figure 10:
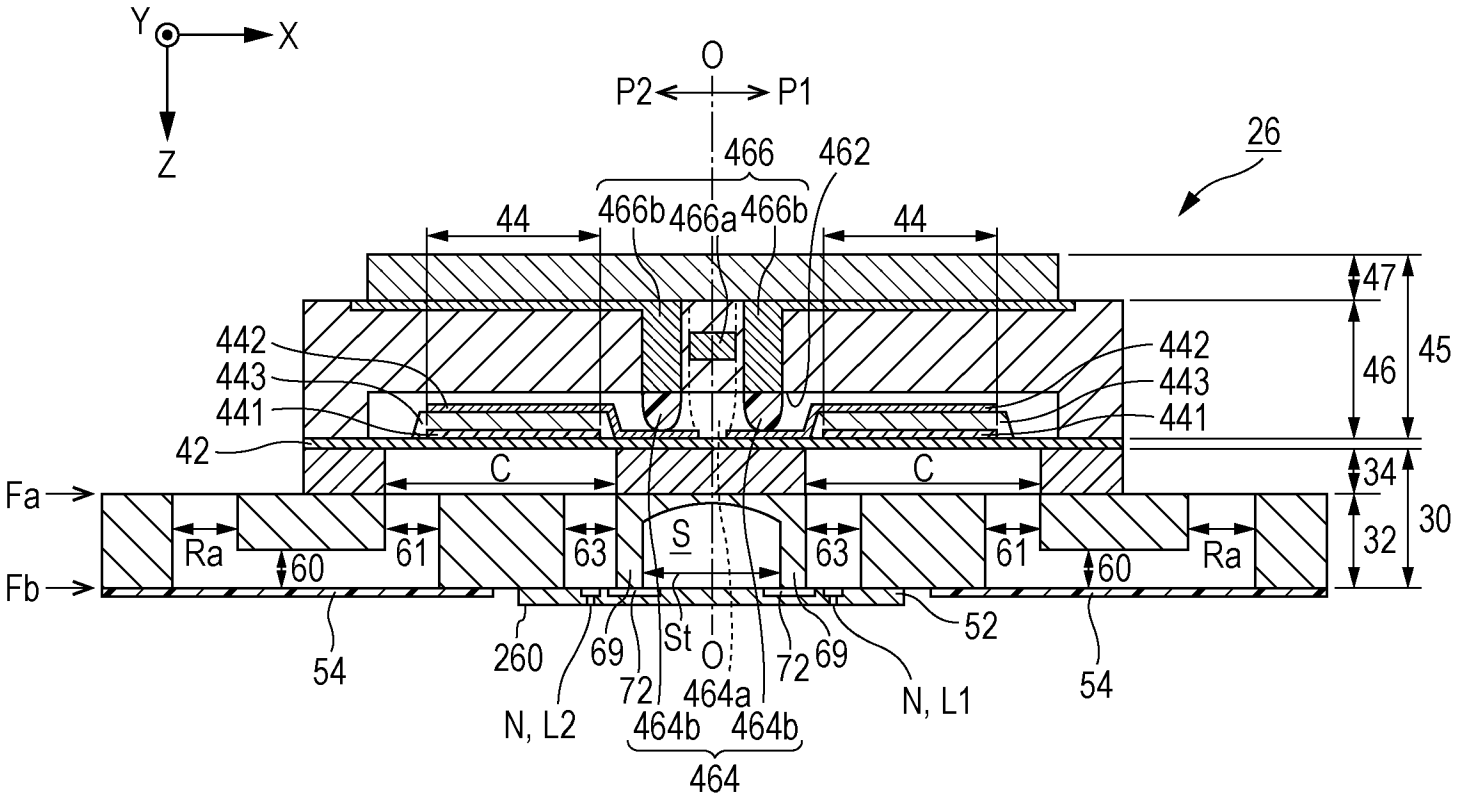
FIG. 10 is a sectional view showing a configuration of a liquid ejecting head according to a second modification example.

FIG. 10 is a sectional view showing a configuration of a liquid ejecting head 26 according to a second modification example, and corresponds to FIG. 4. In the liquid ejecting head 26 of FIG. 10, the case where the flow passage forming section 30 includes a curved surface (an arch portion) where the width St of the above-described cross section is narrowed as getting closer to a surface of the flow passage forming section 30 on the connecting terminals 464 side by making a ceiling Sc of the circulation liquid chamber S (wall surface on the negative side of the Z direction) to be in an arch shape is exemplified. According to the configuration, since the ceiling Sc of the circulation liquid chamber S is a curved surface, it is possible to bring the circulation liquid chamber S close to the connecting terminals 464 side while suppressing stress concentration of the flow passage forming section 30. Therefore, it is possible to make the heat of the connecting terminals 464 easy to escape to the circulation liquid chamber S while suppressing the occurrence of the cracks in the flow passage forming section 30. The shape of the above-described cross section of the circulation liquid chamber S is not limited to the examples shown in FIGS. 9 and 10. For example, the shape of the above-described cross section of the circulation liquid chamber S may include both an inclined surface of a trapezoid shown in FIG. 9 and a curved ceiling Sc as shown in FIG. 10.

Figure 11:
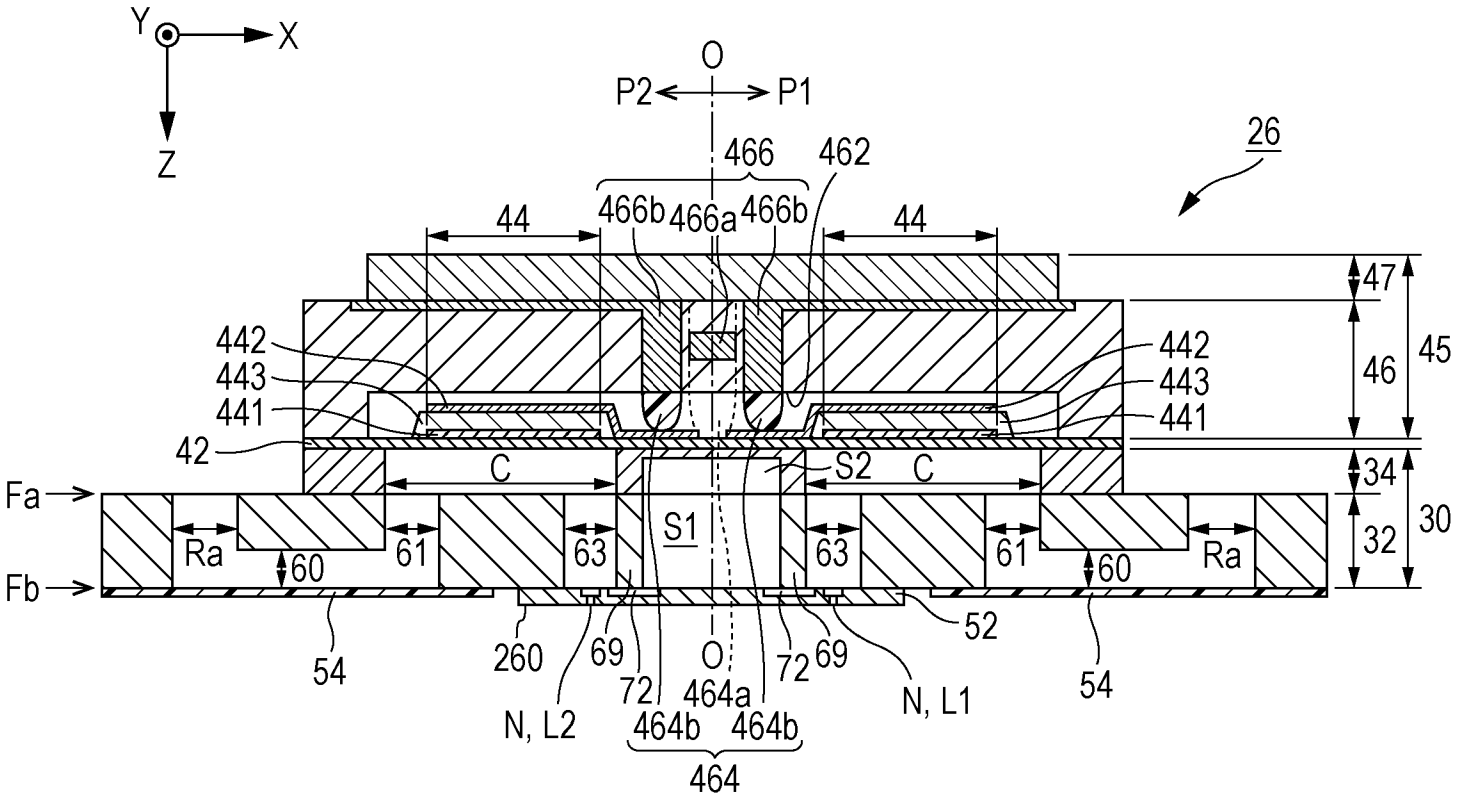
FIG. 11 is a sectional view showing a configuration of a liquid ejecting head according to a third modification example.

In the present embodiment, as shown in FIG. 4, the case where the circulation liquid chamber S is formed in the first flow passage substrate 32 is exemplified. However, the invention is not limited to this, and for example, as shown in FIG. 11, the circulation liquid chamber S may be formed across the first flow passage substrate 32 and the second flow passage substrate 34. FIG. 11 is a sectional view showing a configuration of a liquid ejecting head 26 according to a third modification example, and corresponds to FIG. 4. The circulation liquid chamber S of FIG. 11 is configured of a first space S1 formed in the first flow passage substrate 32 and a second space S2 formed in the second flow passage substrate 34. According to the configuration, since the connecting terminals 464 are disposed on a side of the second flow passage substrate 34 opposite to the second space S2, it is possible to bring the connecting terminals 464 closer to the circulation liquid chamber S compared to the case where the circulation liquid chamber S is formed only in the first flow passage substrate 32. Therefore, it is easier to release the heat from the connecting terminals 464 to the circulation liquid chamber S.

In the present embodiment, as shown in FIG. 4, the case where a single circulation liquid chamber S is formed between the nozzles N of the first nozzle row L1 and the nozzles N of the second nozzle row L2 in the first flow passage substrate 32 is exemplified. However, the invention is not limited to this, and, a plurality of circulation liquid chambers may be formed in the flow passage forming section 30 and the connecting terminals 464 may overlap at least one of a plurality of the circulation liquid chambers in a plan view. According to the configuration, it is possible to increase the circulation amount of the ink since the plurality of circulation liquid chambers are formed in the flow passage forming section 30. Moreover, since the connecting terminals 464 overlap at least one of the circulation liquid chambers in a plan view, the heat released from the connecting terminals 464 to the circulation liquid chambers can be radiated on the flow of the ink in the plurality of circulation liquid chambers. Therefore, it is possible to improve the heat dissipation effect compared to the case where a single circulation liquid chamber is used.

Figure 12:
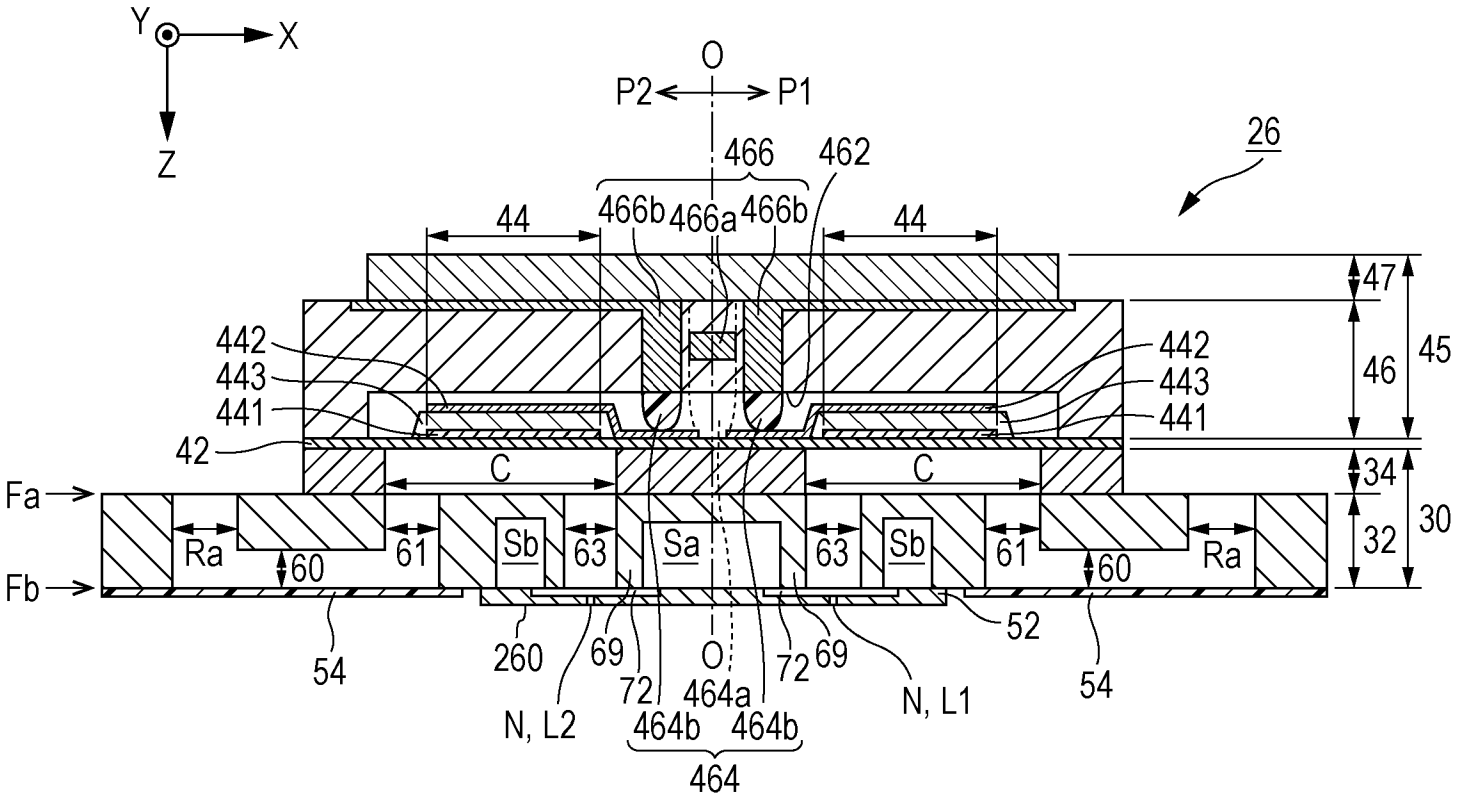
FIG. 12 is a sectional view showing a configuration of a liquid ejecting head according to a fourth modification example.

FIG. 12 is a sectional view showing a configuration of a liquid ejecting head 26 including a plurality of circulation liquid chambers according to a fourth modification example, and corresponds to FIG. 4. In FIG. 12, the case where one circulation liquid chamber Sa (first circulation liquid chamber) and two circulation liquid chambers Sb (second circulation liquid chamber) are formed in the first flow passage substrate 32 is exemplified. The circulation liquid chamber Sa is formed between the nozzles N of the first nozzle row L1 and the nozzles N of the second nozzle row L2 in the first flow passage substrate 32, and corresponds to the circulation liquid chamber S of FIG. 4. One circulation liquid chamber Sb of the two circulation liquid chambers Sb is formed between the nozzles N of the first nozzle row L1 and the supply passages 61 of the first flow passage substrate 32 on the first portion P1 side. The other circulation liquid chamber Sb is formed between the nozzles N of the second nozzle row L2 and the supply passages 61 of the first flow passage substrate 32 on the second portion P2 side. One of the circulation liquid chamber Sb communicates with the circulation liquid chamber Sa via the circulation passages 72 on the first portion P1 side, and the other the circulation liquid chamber Sb communicates with the circulation liquid chamber Sa via the circulation passages 72 on the second portion P2 side. The connecting terminals 464 overlap the circulation liquid chamber Sa in a plan view.

According to the configuration of FIG. 12, since a plurality of the circulation liquid chambers Sa and Sb are formed in the first flow passage substrate 32, it is possible to increase the circulation amount of ink compared to the case where a single circulation liquid chamber is provided. Moreover, since the connecting terminals 464 overlap the circulation liquid chamber Sa in a plan view, the heat released from the connecting terminals 464 to the circulation liquid chamber Sa can be radiated on the flow of the ink in the plurality of circulation liquid chambers Sa and Sb. Therefore, it is possible to improve the heat dissipation effect compared to the case where a single circulation liquid chamber is used. Furthermore, since the circulation liquid chamber Sa does not overlap the pressure chambers C in a plan view and each circulation liquid chamber Sb overlaps the pressure chambers C in a plan view, it is easier to maintain the mechanical strength of the pressure chambers C compared to a configuration in which the circulation liquid chamber Sa and the circulation liquid chamber Sb overlap the pressure chambers C. Therefore, the heat from the connecting terminals 464 can be released while maintaining the mechanical strength of the pressure chambers C.

Second Embodiment

A second embodiment of the invention will be described. For the elements having the same actions and functions as those in the first embodiment in the following examples, the reference numerals used in the description of the first embodiment are used, and the detailed description thereof is appropriately omitted. In the first embodiment, the case where the circuit board 45 is configured by separately laminating the protective member 46 and the driving IC, and the installation space 462 of the piezoelectric elements 44 is sealed with the protective member 46 is exemplified. On the other hand, in the second embodiment, the case where the installation space 462 of the piezoelectric elements 44 is sealed with the circuit board 45 in which the protective member 46 and the driving IC are integrally configured is exemplified.

Figure 13:
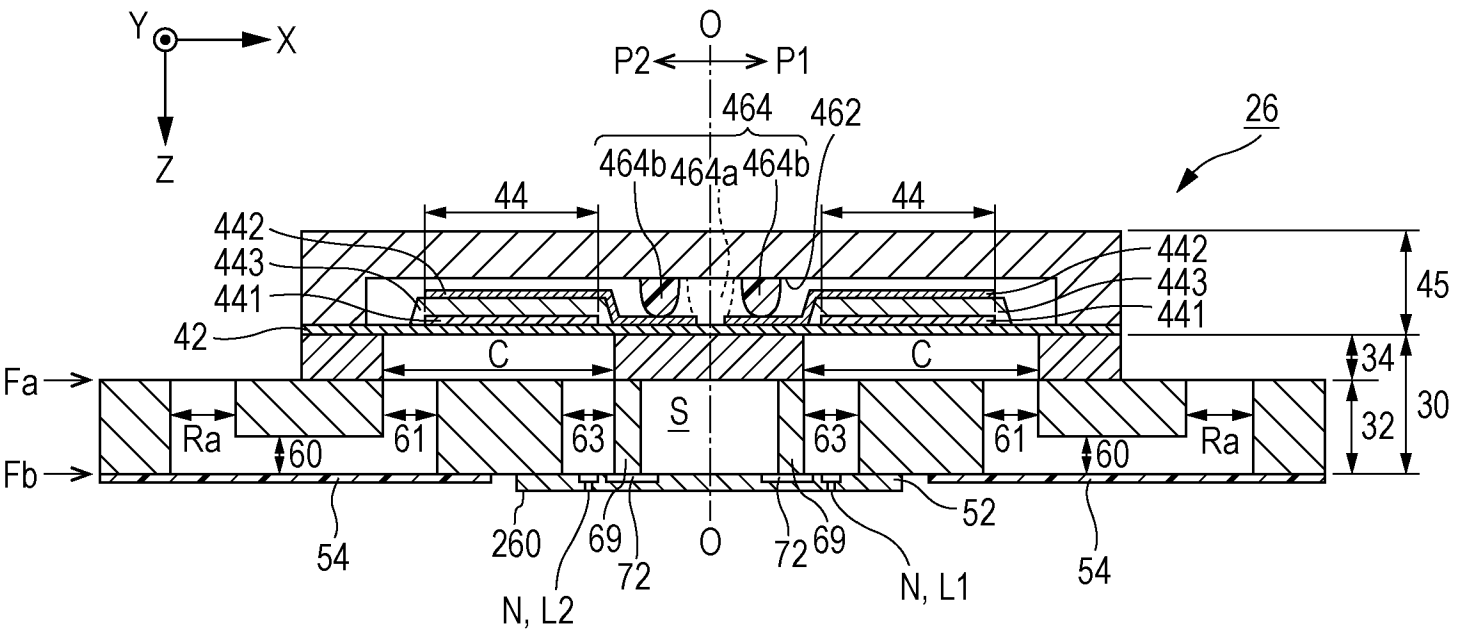
FIG. 13 is a sectional view showing a configuration of a liquid ejecting head according to a second embodiment.

FIG. 13 is a sectional view showing a configuration of a liquid ejecting head 26 according to the second embodiment, and corresponds to FIG. 4. The circuit board 45 of FIG. 13 is laminated on a side of the flow passage forming section 30 opposite to the pressure chambers C and seals the installation space 462 of the piezoelectric elements 44. Therefore, since the circuit board 45 of FIG. 13 also functions as the protective member 46 of FIG. 4, the wirings 466*a* and 466*b* formed in the protective member 46 become unnecessary so that the circuit board 45 of FIG. 13 is directly connected to an electrode of the piezoelectric elements 44 via the connecting terminals 464.

According to the configuration of FIG. 13, since the installation space 462 of the piezoelectric elements 44 can be sealed without the protective member 46, it is possible to release the heat of the connecting terminals 464 to the circulation liquid chamber S while protecting the piezoelectric elements 44. Moreover, since the circuit board 45 is laminated on the flow passage forming section 30 without the protective member 46, it is easier to bring the connecting terminals 464 for connecting the circuit board 45 close to the flow passage forming section 30, and it is easier to release the heat from the circuit board 45 from the connecting terminals 464 to the circulation liquid chamber S. Furthermore, since there is no need to provide the protective member 46, the number of components can be reduced, and the liquid ejecting head 26 can be downsized in the Z direction.

MODIFICATION EXAMPLES

The modes and the embodiments exemplified above can be variously modified. Specific modes of modification are exemplified below. The following examples and two or more modes randomly selected from the above-described modes can be appropriately merged within a range not inconsistent with each other.

(1) In the above-described embodiment, serial heads that repeatedly reciprocates the carriage 242 on which the liquid ejecting head 26 along the X direction is exemplified, but the invention can be applied to a line head in which the liquid ejecting heads 26 are arranged over the entire width of the medium 12.

(2) In the above-described embodiment, the piezoelectric type liquid ejecting head 26 using the piezoelectric element for applying mechanical vibration to the pressure chamber is exemplified, but a thermal type liquid ejecting head using a heat generating element which generates bubbles inside the pressure chamber by heating can be adopted.

(3) The liquid ejecting apparatus 100 exemplified in the above-described embodiment can be employed in various apparatuses such as a facsimile and a copying machine in addition to the apparatus dedicated for printing. However, the application of the liquid ejecting apparatus 100 of the invention is not limited to printing. For example, a liquid ejecting apparatus for ejecting a solution of a coloring material is used as a manufacturing apparatus forming a color filter of a liquid crystal display apparatus, an organic electro luminescence (EL) display, and a surface emitting display (FED). The liquid ejecting apparatus ejecting solution of conductive materials is used as a manufacturing apparatus forming a wiring and an electrode of a wiring substrate. It is also used as a chip manufacturing apparatus for ejecting a solution of bioorganic matter as a kind of liquid.

The present application is based on, and claims priority from JP Application Serial Numbers 2018-008982, filed Jan. 23, 2018, the disclosure of which is hereby incorporated by reference herein in its entirety.

What is claimed is:

1. A liquid ejecting head comprising:

a flow passage forming section comprising a pressure chamber and a circulation liquid chamber, the pressure chamber being in communication with a nozzle for ejecting liquid and the circulation liquid chamber being in communication with the pressure chamber for circulating the liquid;

a driving element configured to generate pressure change in the pressure chamber;

a circuit board configured to drive the driving element; and a connecting terminal that electrically connects the driving element with the circuit board, wherein the connecting terminal overlaps the circulation liquid chamber in a plan view, wherein the flow passage forming section includes:

a first flow passage substrate in which the circulation liquid chamber is formed, and a second flow passage substrate which is bonded to the first flow passage substrate and in which the pressure chamber is formed, and wherein the connecting terminal is disposed on a side of the second flow passage substrate opposite to the first flow passage substrate.

2. The liquid ejecting head according to claim 1, wherein the circulation liquid chamber is configured of a first space formed in the first flow passage substrate and a second space formed in the second flow passage substrate, and wherein the connecting terminal is disposed on a side of the second flow passage substrate opposite to the second space.

3. The liquid ejecting head according to claim 1, wherein the circulation liquid chamber extends in a direction in which a plurality of the pressure chambers are arranged, and wherein the circulation liquid chamber includes a portion where a width of a cross section intersecting with a direction in which the circulation liquid chamber extends decreases as getting closer to a surface of the flow passage forming section on the connecting terminal side.

4. The liquid ejecting head according to claim 3, wherein the circulation liquid chamber includes an inclined surface in which the width of the cross section decreases as getting closer to the surface of the flow passage forming section on the connecting terminal side.

5. The liquid ejecting head according to claim 3, wherein the circulation liquid chamber includes a curved surface in which the width of the cross section decreases as getting closer to the surface of the flow passage forming section on the connecting terminal side.

6. The liquid ejecting head according to claim 1, wherein a plurality of the connecting terminals are provided, and wherein each of the connecting terminals is included in a formation region of the circulation liquid chamber in a plan view.

7. A liquid ejecting head comprising:

a flow passage forming section comprising a pressure chamber and a circulation liquid chamber, the pressure chamber being in communication with a nozzle for ejecting liquid and the circulation liquid chamber being in communication with the pressure chamber for circulating the liquid;

a driving element configured to generate pressure change in the pressure chamber;

a circuit board configured to drive the driving element; and a connecting terminal that electrically connects the driving element with the circuit board, wherein the connecting terminal overlaps the circulation liquid chamber in a plan view, and wherein the circuit board is laminated on the flow passage forming section to seal an installation space of the driving element.

8. The liquid ejecting head according to claim 7, wherein the circuit board includes, a protective member that is laminated on the flow passage forming section to seal the installation space of the driving element, and a driving IC that is mounted on a side of the protective member opposite to the driving element, and wherein the connecting terminal connects the driving element to a wiring formed in the protective member and connected to the driving IC.

9. The liquid ejecting head according to claim 1, wherein the circulation liquid chamber does not overlap the pressure chamber in a plan view.

10. A liquid ejecting head comprising:

a flow passage forming section comprising a pressure chamber and a circulation liquid chamber, the pressure chamber being in communication with a nozzle for ejecting liquid and the circulation liquid chamber being in communication with the pressure chamber for circulating the liquid;

a driving element configured to generate pressure change in the pressure chamber;

a circuit board configured to drive the driving element; and a connecting terminal that electrically connects the driving element with the circuit board, wherein the connecting terminal overlaps the circulation liquid chamber in a plan view, wherein a plurality of the circulation liquid chambers are formed in the flow passage forming section, and wherein the connecting terminal overlaps at least one of the plurality of circulation liquid chambers in a plan view.

11. A liquid ejecting apparatus comprising the liquid ejecting head according to claim 1.

12. The liquid ejecting head according to claim 2, wherein the circulation liquid chamber extends in a direction in which a plurality of the pressure chambers are arranged, and wherein the circulation liquid chamber includes a portion where a width of a cross section intersecting with a direction in which the circulation liquid chamber extends decreases as getting closer to a surface of the flow passage forming section on the connecting terminal side.

13. The liquid ejecting head according to claim 12, wherein the circulation liquid chamber includes an inclined surface in which the width of the cross section decreases as getting closer to the surface of the flow passage forming section on the connecting terminal side.

14. The liquid ejecting head according to claim 12, wherein the circulation liquid chamber includes a curved surface in which the width of the cross section decreases as getting closer to the surface of the flow passage forming section on the connecting terminal side.

15. The liquid ejecting head according to claim 2, wherein a plurality of the connecting terminals are provided, and wherein each of the connecting terminals is included in a formation region of the circulation liquid chamber in a plan view.

16. The liquid ejecting head according to claim 2, wherein the circuit board is laminated on the flow passage forming section to seal an installation space of the driving element.

17. The liquid ejecting head according to claim 16, wherein the circuit board includes, a protective member that is laminated on the flow passage forming section to seal the installation space of the driving element, and a driving IC that is mounted on a side of the protective member opposite to the driving element, and wherein the connecting terminal connects the driving element to a wiring formed in the protective member and connected to the driving IC.

18. A liquid ejecting apparatus comprising the liquid ejecting head according to claim 7.

19. A liquid ejecting apparatus comprising the liquid ejecting head according to claim 8.

* * * * *